US007818108B2

(12) United States Patent
Bertazzoni

(10) Patent No.: US 7,818,108 B2
(45) Date of Patent: Oct. 19, 2010

(54) SYSTEM OF AUTOMATIC CONTROL OF MANEUVER OF MOTOR CRAFTS, RELATED METHOD, AND CRAFT PROVIDED WITH THE SYSTEM

(75) Inventor: Stefano Bertazzoni, Via Pindaro, 39, Rome (IT) I-00124

(73) Assignees: Lorenzo Mongiardo, Rome (IT); Stefano Bertazzoni, Rome (IT)

( * ) Notice: Subject to any disclaimer, the term of this patent is extended or adjusted under 35 U.S.C. 154(b) by 639 days.

(21) Appl. No.: 11/576,833

(22) PCT Filed: Oct. 3, 2005

(86) PCT No.: PCT/IT2005/000571

§ 371 (c)(1),
(2), (4) Date: Apr. 6, 2007

(87) PCT Pub. No.: WO2006/040785

PCT Pub. Date: Apr. 20, 2006

(65) Prior Publication Data

US 2008/0015746 A1 Jan. 17, 2008

(30) Foreign Application Priority Data

Oct. 13, 2004 (IT) ..... RM2004A0498

(51) Int. Cl.
*G05D 1/00* (2006.01)

(52) U.S. Cl. ..... 701/44; 701/21; 701/41; 440/84

(58) Field of Classification Search ..... 701/21, 701/23, 27, 44; 440/84
See application file for complete search history.

(56) References Cited

U.S. PATENT DOCUMENTS 5,832,440 A * 11/1998 Woodbridge et al. ..... 704/275
6,032,087 A * 2/2000 Yamamoto ..... 701/21
6,234,853 B1 5/2001 Lanyi et al.

(Continued)

FOREIGN PATENT DOCUMENTS

DE 101 64 701 A1 4/2004

OTHER PUBLICATIONS

J. Velagic, Z. Vukic, E. Omerdic, "Adaptive fuzzy ship autopilot for track-keeping," Control Engineering Practice, vol. 11, pp. 433-443, 2003.*

(Continued)

*Primary Examiner*—Thomas G Black
*Assistant Examiner*—Peter D Nolan
(74) *Attorney, Agent, or Firm*—Hogan Lovells US LLP

(57) ABSTRACT

The present invention concerns a system of automatic control of manoeuvre of motor crafts that allows, in a reliable and efficient way, to simplify piloting of multi-motor crafts, particularly in manoeuvres within restricted spaces such as for instance, but not exclusively, during phases of mooring, anchoring, or refuelling. In particular, the system automatically compensates the effects of currents, wind and other possible external disturbances upon the craft motion, performing the required movement or maintaining the position and the bow orientation set by the pilot. The present invention further concerns the related method of automatic control of manoeuvre, the processes of calibrating the system, the apparatuses and instruments apt to perform the method, and the motor crafts provided with such a system.

44 Claims, 5 Drawing Sheets

U.S. PATENT DOCUMENTS 6,511,354 B1 1/2003 Gonring et al.
6,752,670 B2 * 6/2004 Geil ..... 440/1
6,868,317 B2 * 3/2005 Okuyama ..... 701/21
6,895,286 B2 * 5/2005 Kaji et al. ..... 700/28
6,995,527 B2 * 2/2006 DePasqua ..... 318/16
7,037,150 B2 * 5/2006 Morvillo ..... 440/40

OTHER PUBLICATIONS

EPO International Search Report; No. PCT/IT2005/000571; Jan. 26, 2006.

* cited by examiner

SYSTEM OF AUTOMATIC CONTROL OF MANEUVER OF MOTOR CRAFTS, RELATED METHOD, AND CRAFT PROVIDED WITH THE SYSTEM

RELATED APPLICATION

The present application claims priority of Italian Patent Application No. RM2004A000498 filed 13 Oct. 2004, and International Patent Application No. PCT/IT2005/000571 filed 3 Oct. 2005, both of the disclosures of which are incorporated herein in their entireties by this reference.

FIELD OF THE INVENTION

The present invention concerns a system of automatic control of manoeuvre of motor crafts that allows, in a reliable and efficient way, to simplify piloting of multi-motor crafts, particularly in manoeuvres within restricted spaces such as for instance, but not exclusively, during phases of mooring, anchoring, or refuelling. In particular, the system is extremely intuitive for a user piloting the craft, and it automatically compensates the effects of currents, wind and other possible external disturbances upon the craft motion, performing the required movement or maintaining the position and the bow orientation set by the pilot. Moreover, the system is usable by crafts provided with shafting, stern motors or outboard motors, or even water jet propulsion, and it is advantageously retrofit applicable even to already existing crafts.

The present invention further concerns the related method of automatic control of manoeuvre, the processes of calibrating the system, the apparatuses and instruments apt to perform the method, and the motor crafts provided with such a system.

BACKGROUND OF THE INVENTION

In particular, in the following, with motor craft it will be meant a craft provided with any propelling and/or manoeuvring means, even water jet propulsions.

It is known that the manoeuvre of multi-motor (or single orientable motor) crafts in restricted spaces entails difficulties due above all to the multiplicity of commands and to their poor intuitiveness which may put the pilot, especially if not skilled, to serious trouble. In any case, even skilled pilots may encounter great difficulties in manoeuvring crafts in particular conditions, such as for instance adverse meteorological conditions wherein not much foreseeable external disturbances may further hamper the manoeuvre.

In order to overcome these problems, some control systems for crafts have been developed based on the use of a control stick lever (or joystick) or other intuitive control means.

U.S. Pat. No. 6,511,354 discloses a single control lever with two degrees of freedom. The first degree of freedom allows the lever to be tilted backwards and forwards. The reversing gear hand lever command is associated with this movement which command simultaneously and in the same way acts upon both stern motors with which the craft is provided. The second degree of freedom allows the lever to be rotated on its axis. An unbalance between the motors is associated to this command so as to promote rotation of the craft according to the direction of rotation of the lever. System operation is controlled by an electronic gearcase controlled by the lever mechanism controlling the two main stern motors, and possibly a bow manoeuvre propeller, arranged according to the transverse axis. In addition, the lever system may operate four switches, two of which are arranged according to a transverse direction, whereas the other two are arranged according to a fore-and-aft direction, so that a forwards-backwards or rightwards-leftwards movement of the lever selectively makes them trip: this system preferably controls a specific, supplementary propelling system for low speed manoeuvre.

U.S. Pat. No. 6,234,853 discloses a control system for crafts substantially based on a joystick controlling an electronic gearcase controlling the main motors and possibly the manoeuvre motors. In order to make the main manoeuvres, this system requires that the motors may orientate their thrust, and therefore the system is applicable only to crafts provided with stern motors or outboard motors. Also, in order to reach its whole operation, the system requires the capacity of manoeuvring the orientation of the two motors independently of one another.

However, the solutions proposed so far suffer from some drawbacks.

First of all, in the proposed systems, a direct and one-to-one relationship exists between the movements of the intuitive control, such as the joystick, and the direction and speed setting of the propelling and manoeuvring means, leaves to the pilot the task of compensating the errors of the control system due to the effects of the craft dynamics, in particular due to the effects of inertia and hull.

Moreover, such systems do not take account of the effects due to external disturbances, such as wind and current.

Still, in the existing systems, the problem of the system calibration depending on the features of the craft and of the motors is not considered.

Furthermore, many of the present manoeuvre aid systems require specific propelling means, which make the systems very complex and expensive and not easily retrofit applicable to already existing crafts.

Finally, such systems do not include the function of maintaining a position and/or an attitude and/or an advance direction which are fixed and selectable by the pilot.

SUMMARY OF THE INVENTION

It is therefore an object of the present invention to provide a system of automatic control of manoeuvre of motor crafts that solves the aforementioned problems, allowing the pilot to directly control, in an intuitive, reliable and efficient way, movements and rotations of the craft, freeing him from the need of controlling individual propelling and manoeuvring means and of taking account of the effects of the craft dynamics and of the external disturbances.

It is still an object of the present invention to provide such a system that simplifies piloting of multi-motor crafts in manoeuvres in restricted spaces, such as for instance, but not exclusively; in phases of mooring, anchoring, or refuelling.

It is specific subject matter of the present invention a system of automatic control of manoeuvre of motor crafts, comprising selectable command means and processing and controlling electronic means connected to the selectable command means, from which it receives one or more signals of selection of a motion and/or a position of the craft to which the system is applied, the processing and controlling electronic means being apt to send one or more control signals to actuator means which control means of propelling and/or manoeuvring the craft, characterised in that the processing and controlling electronic means are further connected to sensing means of the craft from which it receives one or more detection signals, the processing and controlling electronic means processing said one or more detection signals and said one or more selection signals for generating said one or more control signals so as to make the propelling and/or manoeuvring means produce a thrust and/or a moment apt to make the craft assume the motion and/or the position selected by the selectable command means, whereby the system substantially in real time compensates any disturbance of the motion and/or the selected position.

Preferably according to the invention, the processing and controlling electronic means generates said one or more control signals for the actuator means according to a fuzzy logic, having an output variable for each one of said one or more control signals.

Always according to the invention, said fuzzy logic may be of Sugeno type.

Still according to the invention, said fuzzy logic may have inference logic based upon the minimum operation, calculation of the activity coefficient based upon the sum of all the activations for an output, and defuzzyfication based upon the centroid method.

Furthermore according to the invention, said fuzzy logic, for at least one input or output variable, may use a set of membership functions having identical shape and uniformly distributed over a range of values assumable by said at least one input or output variable.

Always according to the invention, said fuzzy logic, for at least one output variable, may use a set of membership functions of singleton type.

Still according to the invention, said fuzzy logic, for at least one input or output variable, may use a set of membership functions depending on one or more first operation parameters.

Furthermore according to the invention, the system may further comprise automatic means of determining the set of membership functions of one or more input and/or output variables of said fuzzy logic.

Always according to the invention, the processing and controlling electronic means may comprise:

- processing means, that processes said one or more detection signals and said one or more selection signals and calculates the value of said thrust and/or the value of said moment;
- thrust generating means, that receives said value of thrust and generates one or more first intermediate signals of thrust control;
- moment generating means, that receives said value of moment and generates one or more second intermediate signals of moment control; and
- control signal generating means, that receives said one or more first intermediate signals of thrust control and said second intermediate signals of moment control and generates said one or more control signals for the actuator means.

Still according to the invention, the system may be apt to operate according to a first operative mode wherein said one or more control signals are generated so as to make the propelling and/or manoeuvring means produce said thrust and/or said moment apt to make the craft assume a translation motion and/or a rotation motion selected by the selectable command means.

Furthermore according to the invention, in the first operative mode, the processing means may calculate a versor $\vec{S}_1=[S_{1x},S_{1y}]=[\cos(\alpha_S),\sin(\alpha_S)]$, representative of the direction of said thrust, on the basis of

- a versor $\vec{A}$ representative of the movement direction selected by the selectable command means, and
- a vector $\vec{I}$ representative of the translation speed detected by the sensing means, through a PID (Proportional, Integral, Derivative) control according to formula:

$$\vec{B}=\vec{A}+TPK\cdot\overrightarrow{T_{En}}+TDK\cdot\left(\overrightarrow{T_{En}}-\overrightarrow{T_{Ed}}\right)+TIK\cdot\sum_{t=n-NI_B}^{n}\overrightarrow{T_{Et}}$$

wherein vector $\vec{T}_E$ is given by formula $$\vec{T}_E=\vec{A}\cdot|\vec{I}|-\vec{I}$$

and where:

- index n indicates the present instant sample,
- index d indicates a sample at an instant preceding the present one,
- index t of summation ranges from $(n-NI_B)$ to n, and
- TPK, TDK, and TIK and $NI_B$ are a first, a second, a third, and a fourth setting parameters, the processing means calculating versor $\vec{S}_1$ according to formula:

$$\vec{S}_1=\vec{B}/|\vec{B}|$$

the processing means further calculating the intensity TH of said thrust proportionally to at least one of said one or more selection signals.

Always according to the invention, in the first operative mode, the processing means may calculate the direction and the intensity of said thrust as a sum of a first vector, representing the direction and the intensity of the translation selected by the selectable command means, with a second vector, proportional to the difference between said first vector and a second vector representing the direction and the intensity of the translation detected by the sensing means.

Still according to the invention, in the first operative mode, when the selectable command means selects no rotation, the processing means may calculate said moment M through a PID control according to formula:

$$\vec{M}=NRPK\cdot\omega_{En}+NRDK\cdot(\omega_{En}-\omega_{Ed})+NRIK\cdot\sum_{t=n-NI_{M1}}^{n}\omega_{Et}$$

where

- $\omega_E$ is equal to the error between the yaw angle $\omega_I$ detected by the sensing means and the yaw angle $\omega$ selected by the selectable command means $\omega_E=\omega_I-\omega$,

- index n indicates the present instant sample,
- index d indicates a sample at an instant preceding the present one,
- index t of summation ranges from $(n-NI_{M1})$ to n, and
- NRPK, NRDK, NRIK and $NI_{M1}$ are a fifth, a sixth, a seventh, and an eighth setting parameters.

Furthermore according to the invention, in the first operative mode (MA), when the selectable command means selects a rotation $R_C$, the processing means calculates said moment M through a PID control according to:

$$\vec{M} = RPK \cdot R_{En} + RDK \cdot (R_{En} - R_{Ed}) + RIK \cdot \sum_{t=n-NI_{M2}}^{n} R_{Et}$$

where $R_E$ is equal to the error between the selected rotation $R_C$ and the rotation speed $$\frac{d\omega}{dt}$$

detected by the sensing means $$R_E = R_C - \frac{d\omega}{dt},$$

index n indicates the present instant sample, index d indicates a sample at an instant preceding the present one, index t of summation ranges from $(n-NI_{M2})$ to n, and RPK, RDK, RIK and $NI_{M2}$ are a ninth, a tenth, an eleventh, and a twelfth setting parameters.

Always according to the invention, the processing means may further calculate a control parameter KTM that is sent to the force compounding means, that uses it in generating said one or more control signals for the actuator means for assigning a weight to said second intermediate signals of moment control with respect to said one or more first intermediate signals of thrust control, the control parameter KTM being calculated as a function of the $R_C$ selected by the selectable command means according to formula:

$$KTM = \begin{cases} |TMRFG \cdot R_E| & \text{for } R_C \neq 0 \\ |TMHFG \cdot \omega_E| & \text{for } R_C = 0 \end{cases}$$

where $R_E$ is equal to the error between the selected rotation $R_C$ and the rotation speed $$\frac{d\omega}{dt}$$

detected by the sensing means $$R_E = R_C - \frac{d\omega}{dt},$$

$\omega_E$ is equal to the error between the yaw angle $\omega_I$ detected by the sensing means and the yaw angle $\omega$ selected by the selectable command means $\omega_E = \omega_I - \omega$, and TMRFG and TMHFG are a thirteenth and a fourteenth setting parameters.

Still according to the invention, the system may be apt to operate according to a second operative mode in which said one or more control signals are generated so as to make the propelling and/or manoeuvring means produce said thrust and/or said moment apt to make the craft maintain a position and/or a bow angle selected by the selectable command means.

Furthermore according to the invention, said one or more control signals may be generated when the deviations of the position and/or the bow angle detected by the sensing means from the position and/or the bow angle selected by the selectable command means are larger than, respectively, a first and a second maximum threshold.

Always according to the invention, said one or more control signals may be generated giving priority to the maintenance of the position.

Still according to the invention, in the second operative mode, the processing means may calculate a vector $\vec{S}$ representative of said thrust through a PID control according to formula:

$$\vec{S} = PHPK \cdot \vec{C_n} + PHDK \cdot \left(\vec{C_n} - \vec{C_d}\right) + PHIK \cdot \sum_{t=n-NI_S}^{n} \vec{C_i}$$

where $\vec{C}$ is a vector representative of a corrective movement, equal to the difference between a vector $\vec{SP}$ representative of the position selected by the selectable command means, and a vector $\vec{AP}$ representative of the position detected by the sensing means $$\vec{C} = \vec{SP} - \vec{AP},$$

index n indicates the present instant sample, index d indicates a sample at an instant preceding the present one, index t of summation ranges from $(n-NI_S)$ to n, and PHPK, PHDK, PHIK and $NI_S$ are a fifteenth, a sixteenth, a seventeenth, and an eighteenth setting parameters.

Furthermore according to the invention, in the second operative mode, the processing means may calculate said moment M through a PID control according to formula:

$$\vec{M} = RPK \cdot R_{En} + RDK \cdot (R_{En} - R_{Ed}) + RIK \cdot \sum_{t=n-NI_{M2}}^{n} R_{Et}$$

where $R_E$ is equal to the error between the selected rotation $R_C$ and the rotation speed $$\frac{d\omega}{dt}$$

detected by the sensing means $$R_E = R_C - \frac{d\omega}{dt},$$

index n indicates the present instant sample, index d indicates a sample at an instant preceding the present one, index t of summation ranges from $(n-NI_{M2})$ to n, and RPK, RDK, RIK and $NI_{M2}$ are a ninth, a tenth, an eleventh, and a twelfth setting parameters.

Always according to the invention, the thrust generating means may generate each one of said one or more first intermediate signals of thrust control as a defuzzyfied output variable calculated through said fuzzy logic, employing as input variables the direction and the intensity of said thrust value.

Still according to the invention, the moment generating means may generate each one of said one or more second intermediate signals of moment control as a defuzzyfied output variable calculated through said fuzzy logic, employing as input variables the intensity of said moment value.

Always according to the invention, the control signal generating means may comprise force compounding means that generates at least one compounded signal $A_{TOT}^j$, corresponding to one of said one or more control signals for the actuator means, through the sum of a corresponding first intermediate signal $A_{TG}^j$, from said one or more first intermediate signals of thrust control, with a corresponding second intermediate signal $A_{MG}^j$, from said second intermediate signals of moment control:

$$A_{TOT}^j = A_{TG}^j + A_{MG}^j.$$

Furthermore according to the invention, the force compounding means may generate said at least one compounded signal $A_{TOT}^j$ by weighing the contributions to said sum, given by the corresponding first intermediate signal $A_{TG}^j$ and by the corresponding second intermediate signal $A_{MG}^j$, through the control parameter KTM according to formula:

$$A_{TOT}^j = (1-KTM)A_{TG}^j + (1+KTM)A_{MG}^j.$$

Always according to the invention, the control signal generating means may comprise controlling means apt to control and give the values of said one or more control signals for the actuator means.

Still according to the invention, the controlling means may prevent at least one signal of control of rotation of a motor, from said one or more control signals for the actuator means, from producing abrupt changes of the rotation condition of said motor.

Furthermore according to the invention, the controlling means may prevent at least one signal ($A^{j-ROT}$) of control of rotation of a motor, from said one or more control signals for the actuator means, from producing consecutive and close reversals of the rotation direction of said motor.

Always according to the invention, at least one compounded signal $A_{TOT}^j$ generated by the force compounding means may be modified by a respective digital finite impulsive response or FIR filter.

Still according to the invention, said FIR filter may depend on one or more second operation parameters.

Furthermore according to the invention, at least one compounded signal $A_{TOT}^j$ generated by the force compounding means may be re-scaled.

Always according to the invention, the value $A^j$ of at least one control signal for the actuator means may be given by a respective hysteretic function $f_H^j$ of a corresponding compounded signal $A_{TOT}^j$ generated by the force compounding means:

$$A^j = f_H(A_{TOT}^j)$$

Still according to the invention, said hysteretic function $f_H^j$ may depend on one or more third operation parameters.

Furthermore according to the invention, the system may operate according to at least one parameter of operation or setting determinable through at least one calibration process.

Always according to the invention, said at least one determinable parameter may be one of said one or more first operation parameters defining a singleton of an output variable of said fuzzy logic.

Still according to the invention, said at least one calibration process may be automatic.

Always according to the invention, the system may further comprise multiplexing means, connected to the processing and controlling electronic means from which it is apt to receive as input at least one part of said one or more control signals, the multiplexing means being further connected at the input to one or more control instruments, with which the craft is provided, each one of which is apt to generate one or more further control signals corresponding to said at least one part of said one or more control signals generated by the processing and controlling electronic means, the multiplexing means being connected at the output to the actuator means, whereby the multiplexing means alternatively forwards to the actuator means the input signals coming from the processing and controlling electronic means or from said one or more control instruments.

Furthermore according to the invention, the multiplexing means may be selectable, whereby the input signals to forward to the output may be selected.

Always according to the invention, the selectable command means may send to the processing and controlling electronic means one or more signals of selection of a translation motion and/or of a rotation motion and/or of a position and/or of an attitude of the craft.

Still according to the invention, the selectable command means may comprise at least one command unit comprising a joystick and/or a pointing device and/or a lever device or control stick and/or a touch-screen and/or a speech command computerised device and/or a keypad and/or a radio control.

Furthermore according to the invention, at least one command unit may be connected to the processing and controlling electronic means through a wireless connection.

Always according to the invention, said wireless connection may be a connection according to WiFi technology.

Still according to the invention, the system may further comprise displaying means and/or acoustic and/or visual signalling means.

Furthermore according to the invention, the sensing means may comprise a GPS position sensor and/or an electronic compass and/or an anemometer and/or a liquid current meter.

It is still specific subject matter of the present invention a method of automatic control of manoeuvre of motor crafts, apt to be executed by the processing and controlling electronic means of a system of automatic control of manoeuvre of motor crafts as previously described, comprising the steps of:

A. receiving one or more selection signals of a motion and/or a position of the craft from selectable command means, and D. sending one or more control signals to actuator means which control propelling and/or manoeuvring means of the craft, the method being characterised in that it further comprises the following steps B. receiving one or more detection signals from sensing means of a craft, and C. processing said one or more detection signals and said one or more selection signals for generating said one or more control signals so as to make the propelling and/or manoeuvring means produce a thrust and/or a moment apt to make the craft assume the motion and/or the position selected by the selectable command means, whereby the system substantially in real time compensates any disturbance of the selected motion and/or position.

Preferably according to the invention, step C generates said one or more control signals according to a fuzzy logic, having an output variable for each one of said one or more control signals.

Always according to the invention, said fuzzy logic may be of Sugeno type and/or may have inference logic based upon the minimum operation, calculation of the activity coefficient based upon the sum of all the activations for an output, and defuzzyfication based upon the centroid method.

Still according to the invention, said fuzzy logic, for at least one input or output variable, may use a set of membership functions having identical shape and uniformly distributed over a range of values assumable by said at least one input or output variable.

Furthermore according to the invention, said fuzzy logic, for at least one output variable, may use a set of membership functions of singleton type.

Always according to the invention, said fuzzy logic, for at least one input or output variable, may use a set of membership functions depending on one or more first operation parameters.

Still according to the invention, the method may further comprise a preliminary step of automatically determining the set of membership functions of one or more input and/or output variables of said fuzzy logic.

Furthermore according to the invention, step C may comprise the following sub-steps:

C.1 processing said one or more detection signals and said one or more selection signals and calculating the value of said thrust and/or the value of said moment, C.2 generating, from said thrust value, one or more first intermediate signals of thrust control, C.3 generating, from said moment value, one or more second intermediate signals of moment control, and C.4 generating, from said one or more first intermediate signals of thrust control and said second intermediate signals of moment control, said one or more control signals.

Always according to the invention, sub-step C.2 may generate each one of said one or more first intermediate signals of thrust control as defuzzyfied output variable calculated through said fuzzy logic, employing as input variables the direction and the intensity of said value of thrust.

Still according to the invention, sub-step C.2 may generate each one of said one or more second intermediate signals of moment control as defuzzyfied output variable calculated through said fuzzy logic, employing as input variables the direction and the intensity of said value of moment.

It is further specific subject matter of the present invention a calibration process of one or more parameters of operation or setting of a system of automatic control of manoeuvre of motor crafts as previously described, said one or more parameters being related to the generation of one or more control signals apt to make propelling and/or manoeuvring means produce a rotation of the craft, the process starting from an initial set of said one or more parameters of rotation, the process being characterised in that it comprises the following step:

J. producing one or more selection signals of a rotation motion, for making the system generate one or more control signals, K. calculating the distance $D^{ROT}$ run by the barycentre of the craft, L. verifying whether the distance $D^{ROT}$ is shorter than a predetermined maximum threshold $D^{ROT_MAX}$, M. in the case when step L gives a positive outcome, memorising the set of rotation parameters used by the system for generating said one or more control signals and ending the process, N. in the case when step L gives a negative outcome, modifying one or more rotation parameters so as to reduce the distance $D^{ROT}$ and repeating the process starting from step J.

Always according to the invention, step N may comprise the following sub-steps:

N.1 verifying whether the craft turns the bow towards the outside of a circle the diameter of which is equal to the distance $D^{ROT}$ and that is tangent to a vector representative of the speed of the craft barycentre at the end of rotation, said circle being placed within the half plane to which the barycentre position belongs at the beginning of rotation, N.2 in the case when sub-step N.1 gives a positive outcome, modifying said one or more rotation parameters so as to reduce the leftward thrust, with respect to the rightward thrust, of the propelling and/or manoeuvring means of the craft, and N.3 in the case when sub-step N.1 gives a negative outcome, modifying one or more rotation parameters so as to reduce the rightward thrust, with respect to the leftward thrust, of the propelling and/or manoeuvring means of the craft.

It is always specific subject matter of the present invention a second calibration process of one or more parameters of operation or setting of a system of automatic control of manoeuvre of motor crafts as previously described, said one or more parameters being related to the generation of one or more control signals apt to make propelling and/or manoeuvring means produce a translation of the craft, the process starting from an initial set of said one or more translation parameters, the process being characterised in that it comprises, for at least one direction of translation, the following step:

P. producing one or more signals of selection of a translation motion, for making the system generate one or more control signals, Q. calculating the angular error $E_{\Delta CI}$ of the direction of translation effectively followed by the craft, detected by the sensing means, with respect to the direction of the selected translation motion, R. verifying whether the angular error $E_{\Delta CI}$ is lower than a predetermined maximum threshold $E_{C_MAX}$, S. in the case when step R gives a positive outcome, memorising the set of translation parameters used by the system for generating said one or more control signals and ending the process, T. in the case when step R gives a negative outcome, modifying said one or more translation parameters so as to reduce the angular deviation $E_C$ and repeating the process starting from step P.

Always according to the invention, step S may memorise the set of translation parameters used by the system for generating said one or more control signals only if a vector representative of a correction of said translation, that is induced by the processing and controlling electronic means (30), is lower in module than a respective predetermined maximum threshold $TM_{MAX}$, otherwise step T is executed.

It is still specific subject matter of the present invention a craft, comprising actuator means, that controls propelling and/or manoeuvring means, and sensing means, characterised in that it is provided with the system of automatic control of manoeuvre of motor crafts as previously described.

BRIEF DESCRIPTION OF THE DRAWINGS

The present invention will now be described, by way of illustration and not by way of limitation, according to its preferred embodiment, by particularly referring to the Figures of the enclosed drawings, in which.

In the Figures, alike elements are indicated by same reference numbers.

DETAILED DESCRIPTION OF PREFERRED EMBODIMENTS

Figure 1:
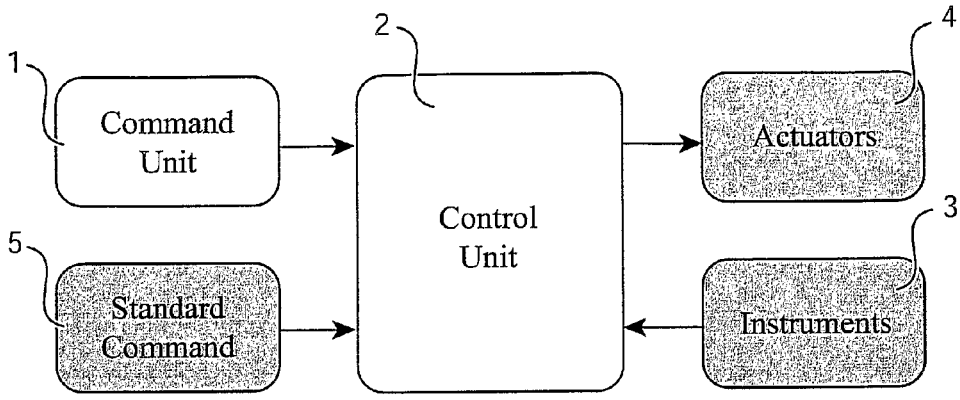
FIG. 1 shows a preferred embodiment of the system according to the invention.

The system according to the invention replaces the normally used commands with a sole intuitive control device, such as for instance a joystick, through which craft translations and rotations are directly controlled.

In particular, in the following of the description reference will be mainly made to a joystick as control device operatable by the pilot. However, it must be taken account of the fact that the system according to the invention may alternatively or additionally comprise other operatable control devices, such as, for instance, a mouse or track-ball pointing device, a lever device or control stick, a touch-screen, a speech command computerised device, a keypad, a radio control.

The joystick is connected to an electronic gearcase controlling the inboard apparatuses for performing the manoeuvre selected by the pilot. The system according to the invention automatically takes account of the effects of currents, wind, and other possible disturbances, automatically compensating in real time such effects through the operation of the motors in order to perform the selected movement and/or the rotation or to maintain the position and the bow direction set by the pilot. In fact, the system according to the invention is structured so as to directly control the craft motion of translation and rotation through the analysis of the real motion and possibly of the environmental parameters such as wind and current.

Also, the system according to the invention has the capacity to adapt to the craft through an automatic procedure of calibration to be executed at the moment of installation, and possibly periodically and/or each time craft structural changes make it necessary.

In particular, the system according to the invention does not require specific manoeuvring means, but it is capable to use one or more main motors. In fact, it is applicable to crafts provided with right ad left main motors, preferably placed at stern, or with a single orientable motor (preferably accompanied by a stern manoeuvring motor), and possibly advantageously also provided with a bow manoeuvring transverse motor. Even if not strictly necessary, other propelling means may be used for improving performances of the system. The system is further advantageously applicable to crafts provided with shafting or stern motors or outboard motors. In case of single main motor or not reversely rotating propellers, it is preferably required a stern manoeuvring motor, or a similar manoeuvring apparatus (such as for instance, in yachts, a transverse water jet underwater periscope).

The preferred embodiment of the system according to the invention has three base operative modes: off or OFF mode, manoeuvring assistance or MA (Manoeuvring Assistant) mode, and position maintenance or PH (Position Holder) mode. In the OFF mode, the system is substantially inactive and it is completely transparent, the standard commands with which the craft is provided being activated. In the MA mode, the system electronic gearcase controls the propelling means and the possible manoeuvring means, allowing the pilot to directly control, through the intuitive control device, the craft motion of translation and/or rotation. In the PH mode, the system operates the propelling means propelling means and the possible manoeuvring means so as to maintain the selected position and bow direction.

With reference to FIG. 1, it may be observed that the preferred embodiment of the system comprises a command unit 1 and a control unit 2.

The command unit 1 is the interface between the pilot and the system according to the invention. As said, it may be based on different types of devices, such as, for instance, joystick, track-ball, touch-screen or any other device or set of devices allowing to specify the motion of translation and/or rotation that is desired to obtain and/or the position and/or the attitude that is desired to maintain. Alternatively according to the invention, the function of the command unit 1 may possibly be carried out by other inboard apparatuses intended for piloting the craft, in order to obtain more sophisticated functions.

Other embodiments of the system according to the invention may be provided with different command units operating independently of one another or in combination with one another; such units may also be portable, for instance based on wireless, preferably WiFi, technology, so as to allow the pilot to pilot the craft from various positions (for instance even from land during manoeuvres of mooring).

The command unit 1 of the preferred embodiment of the system according to the invention is advantageously provided with display devices for showing to the pilot information, possibly also received by the control unit 2 and by detecting means external to the system (such as radar and/or sonar), useful for piloting the craft.

The control unit 2 has the task of processing data coming from the command unit 1, and from inboard instruments 3 (comprising several sensor such as, for instance, GPS position sensor, an electronic compass, and an anemometer) in order to generate signals for controlling the actuators 4, which control the manoeuvring means (such as, for instance, motor-reversing gears, a rudder, manoeuvring motors) for performing the selected movement or maintaining the selected position and attitude. In the case when the system operates in OFF mode, the control unit 2 is transparent, and the signals coming from the inboard standard commands 5 are directly sent to the related actuators 4. The operating mode is selected by a suitable selector (not shown) of the command unit 1. Preferably, the system operates according to the OFF mode even in case of unsuccessful connection with a command unit 1 and/or at each activation of the inboard standard commands 5.

Figure 2:
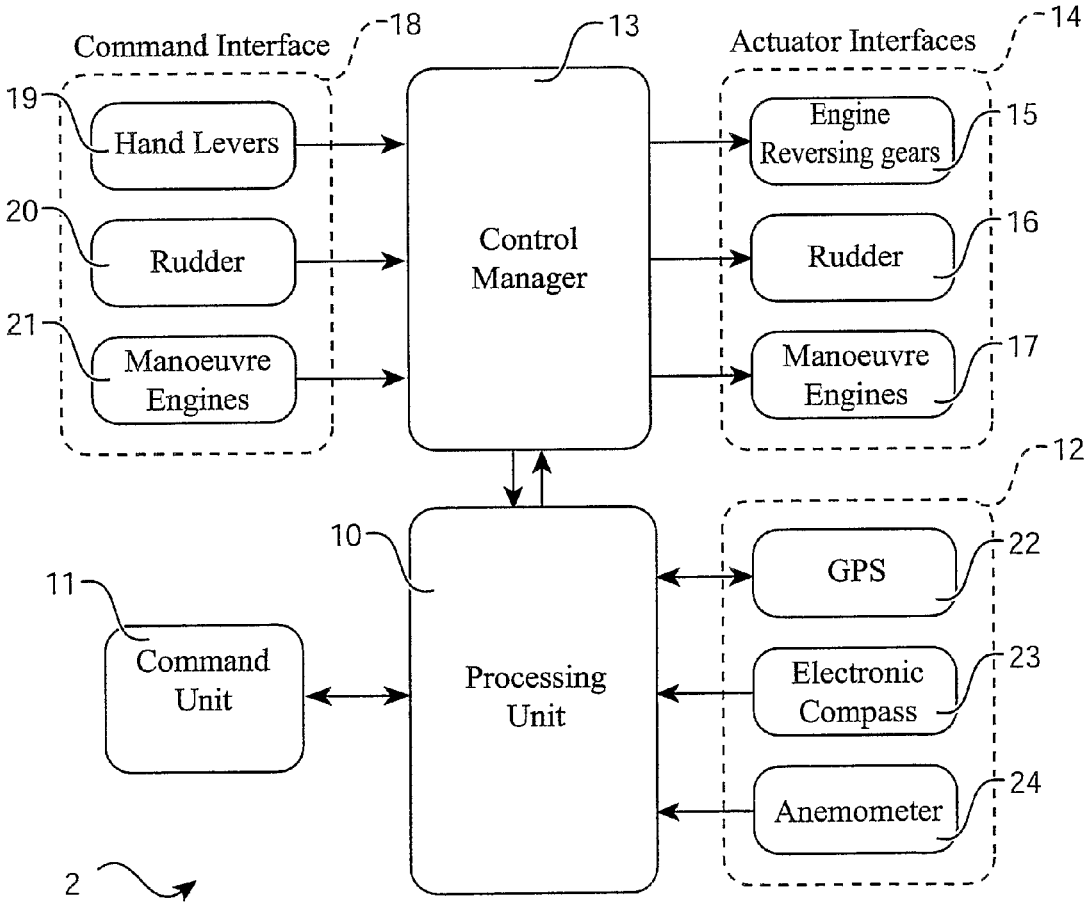
FIG. 2 shows in greater detail a part of the system of FIG. 1.

With reference to FIG. 2, it may be observed that the control unit 2 comprises a processing device 10, controlling the system according to the invention, to which a first unit 11 of interface with the command unit 1 and a second unit 12 interface with the inboard instruments 3 are connected. In particular, the first interface unit 11, that possibly comprises wireless communication devices, may be apt to communicate through safe protocols with a plurality of, possibly remote, command units 1. As shown in FIG. 2, the second interface unit 12 may comprise for instance three sub-units 22, 23, and 24 of interface with, respectively, a GPS sensor, an electronic compass, and a wind direction and intensity sensing device.

The processing device 10 is the base element of the system that, in the MA and PH operating modes, processes information coming from the first and second interface units 11 and 12 for generating control signals sent to the actuators 4 of the manoeuvring means through a control signal multiplexing unit 13 and a third unit 14 of interface with the actuators 4. In FIG. 2, the third interface unit 14 comprises three sub-units 15, 16, and 17 of interface with, respectively, the actuators of the motor-reversing gears, the actuators of the rudder, and the actuators of the manoeuvring motors.

The multiplexing unit 13 is apt to restore the direct connection between the inboard standard commands 5 and the related actuators 4 in the case when the system according to the invention is not powered and/or in the case when it operates in OFF mode or a standard command is used. To this end, a fourth unit 18 of interface with the inboard instruments standard 5 is connected with the multiplexing unit 13, that in FIG. 2 comprises three sub-units 19, 20, and 21 of interface with, respectively, one or more motor-reversing gear control hand levers, the rudder, and the manoeuvring motor control instruments.

In particular, the second, the third and the fourth interface units 12, 14, and 18 (which possibly may comprise wireless communication devices) implement the various communication standards normally used in the nautical field, allowing equipments and instruments possibly already present on the craft to be used. It is clear that, in the case when the system is applied to newly manufactured crafts, such interfaces could be directly integrated into the processing device 10 and/or the multiplexing unit 13. However, the preferred embodiment of the system is provided with such interfaces separated even in the case when it is applied to new crafts, so as to possibly allow protocols of communication with equipments and instruments to be more easily changed (in the case when, for instance, these are updated).

Figure 3:
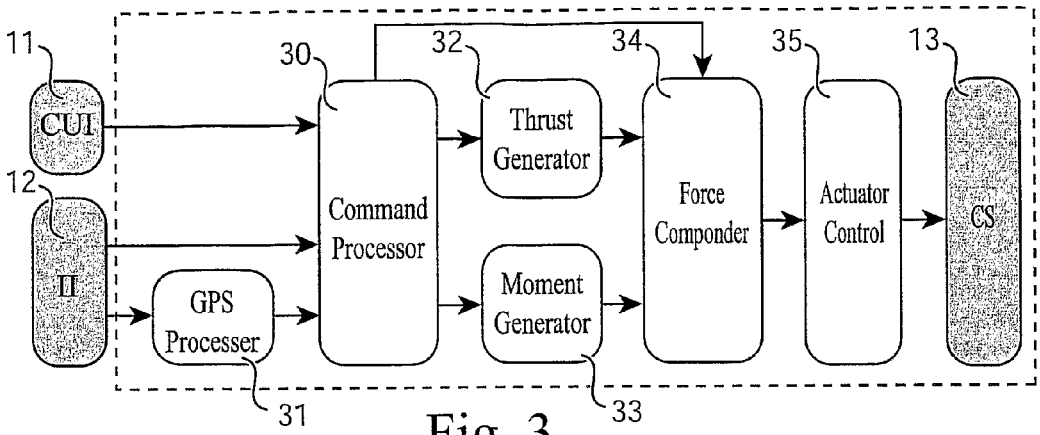
FIG. 3 shows in greater detail a portion of the part of FIG. 2.

With reference to FIG. 3, it may be observed that the processing device 10 comprises a processing unit 30 receiving as input, from the first interface unit 11, the command to execute as selected by the pilot through the command unit 1, and, from the second interface unit 12, feedback data detected by the instruments 3. In particular, the processing unit 30 calculates the values of moment and thrust to be wholly produced by the manoeuvring means for obtaining the selected movement or for maintaining the selected position and attitude, taking account of the external disturbances and the craft dynamics given by a GPS processing unit 31, receiving data given by the sub-unit 22 of interface the GPS sensor.

The processing unit 30 provides a thrust generator 32 with the value of the thrust to generate, so that the latter generates the signals necessary to the third interface unit 14 for controlling the actuators 4 so as to adjust the single manoeuvring means so as to wholly produce the required thrust. Similarly, a moment generator 33 receives from the processing unit 30 the value of the moment to generate and produces the signals necessary to the third interface unit 14 for controlling the actuators 4 so as to adjust the single manoeuvring means so as to wholly produce the moment required by the unit 30.

The signals separately generated by the thrust and moment generators, respectively 32 and 33, are compounded by a force compounding unit 34, that preferably gives priority to the moment adjusting signals. In other words, the force compounding unit 34 calculates, for each actuator, the whole control signals for making the manoeuvring means produce both the thrust and the rotation moment apt to cause roto-translatory movements corresponding to what selected by the command unit 1.

Finally, an actuator signal controller 35 prepares the signals coming from the force compounding unit 34 for their successive transmission to the third interface unit 14, through the multiplexing unit 13.

In particular, in the MA operating mode, the processing unit 30 generates the thrust and the moment so as to obtain the manoeuvre selected by the command unit 1, while, in the PH operating mode, it generates the thrust and the moment so as to oppose the external disturbances and maintaining the selected position and attitude.

More specifically, in the MA mode, the processing unit 30 generates the thrust and the moment on the basis of the signal corresponding to the selected command coming from the command unit 1 and of the data related to the effective movement direction and bow angle as detected by the inboard instruments 3. In other words, the processing unit 30 closes the feedback loop controlling the craft movement direction and rotation, compensating the effects of external forces, inertia and other possible error causes.

Figure 4:
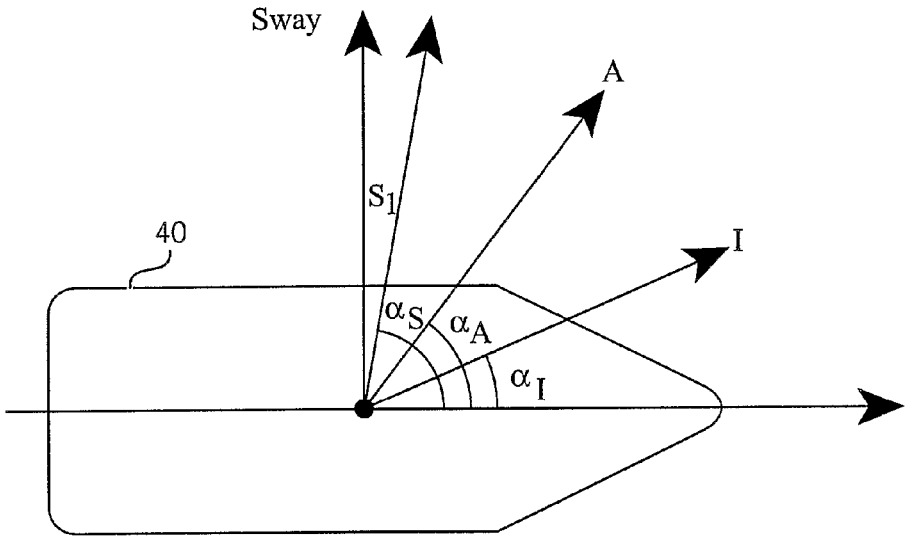
FIG. 4 schematically shows some quantities considered by the system of FIG. 1.

With reference to FIG. 4, wherein a craft 40 on which the system according to the invention is applied is schematically depicted, the direction $\alpha_S$ of the thrust $\vec{S}=TH\cdot\vec{S}_1$ to produce through the manoeuvring means, represented by the versor $\vec{S}_1=[S_{1x},S_{1y}]=[\cos(\alpha_S),\sin(\alpha_S)]$, is determined on the basis of:

the versor of the movement direction selected by the command unit 1 $\vec{A}=[A_x,A_y]=[\cos(\alpha_A),\sin(\alpha_A)]$, and the vector of the movement speed detected by the inboard instruments 3 $\vec{I}[=I_x,I_y]=[\cos(\alpha_I),\sin(\alpha_I)]$, where x and y respectively indicate the fore-and-aft axis or surge and the transverse axis or sway.

In particular, the direction $\alpha_S$ of the thrust to apply to the craft 40, that is equal to $$\alpha_S = \operatorname{arctg}\left(\frac{S_{1y}}{S_{1x}}\right)$$

is preferably determined through a PID (Proportional, Integral, Derivative) control, represented by formula:

$$\vec{B} = \vec{A} + TPK \cdot \overrightarrow{T_{En}} + TDK \cdot (\overrightarrow{T_{En}} - \overrightarrow{T_{Ed}}) + TIK \cdot \sum_{t=n-NI_B}^{n} \overrightarrow{T_{Et}} \quad [1A]$$

wherein $$\vec{T}_E = \vec{A} \cdot |\vec{I}| - \vec{I} \quad [1B]$$

and where:

index n indicates the present instant sample, index d indicates a sample at an instant preceding the present one, used for the calculation of the derivative contribution, summation index t ranges from $(n-NI_B)$ to n, so adding $NI_B$ successive samples up to the present instant sample for the calculation of the integral contribution, and TPK, TDK, TIK are coefficients, possibly null.

In particular, TPK, TDK, TIK and $NI_B$ are a first, a second, a third, and a fourth system setting parameters. Obviously, index d may be also a further system setting parameter.

The versor $\vec{S}_1$ of the thrust to produce is equal to:

$$\vec{S}_1 = \vec{B}/|\vec{B}| \quad [1C]$$

and, as resulting from formula [1B], the module of the movement speed vector $\vec{I}$ allows to modulate the direction $\alpha_S$ of the thrust to produce on the basis of the craft speed.

Once the thrust direction $\vec{S}_1$ is determined, the processing unit 30 determines its intensity TH as proportional to the command selected by the command unit 1, so determining the thrust $\vec{S} = TH \cdot \vec{S}_1$.

Alternatively, thrust direction and intensity may be determined by the sum of a first vector, representing the direction and the intensity of the movement selected by the command unit 1, with a second vector, proportional to the difference between the first vector and the vector representing the direction and the intensity of the movement detected by the inboard instruments 3.

Figure 5:
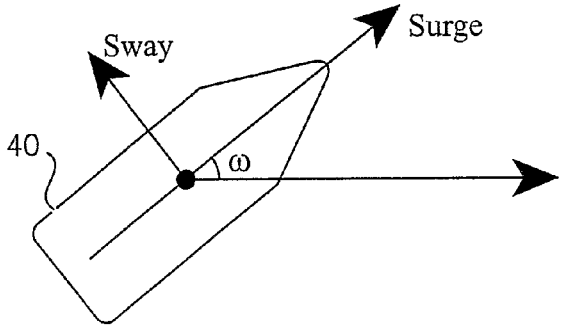
FIG. 5 schematically shows a further quantity considered by the system of FIG. 1.

With reference to FIG. 5, wherein the so-called yaw angle ω of a craft 40 on which the system according to the invention is applied is schematically represented, the calculation of the moment is performed according to two different way depending on whether the pilot requires a rotation, selected through the command unit 1, or not.

In the latter case, the system according to the invention must substantially maintain a rectilinear advance of the craft 40 with the bow oriented according to a selected yaw angle ω. In this case, the yaw angle $\omega_I$ indicated by the inboard instruments 3 is considered for calculating the yaw error angle $\omega_E$ according to:

$$\omega_E = \omega_I - \omega \quad [2]$$

where ω is the value of the selected yaw angle to maintain. The moment M to apply to the craft 40 is determined starting from the yaw error angle $\omega_E$, preferably through a PID control represented by formula:

$$\vec{M} = NRPK \cdot \omega_{En} + NRDK \cdot (\omega_{En} - \omega_{Ed}) + NRIK \cdot \sum_{t=n-NI_{M1}}^{n} \omega_{Et} \quad [3]$$

where:

indexes n, d, and t are similar to the homologous ones of formula [1A], the summation so adding $NI_{M1}$ successive samples up to the present instant sample for the calculation of the integral contribution, and NRPK, NRDK, NRIK are coefficients, possibly null.

In particular, NRPK, NRDK, NRIK and $NI_{M1}$ are a fifth, a sixth, a seventh, and an eighth system setting parameters (and possibly even index d is a further system setting parameter).

In the case when the command unit 1 imposes a rotation $R_C$, the moment M to apply to the craft 40 is determined starting from the error $R_E$ between the selected rotation $R_C$ and the detected rotation speed $$\frac{d\omega}{dt};$$

$$R_E = R_C - \frac{d\omega}{dt} \quad [4]$$

whereby the moment to apply is determined through a PID control represented by formula:

$$\vec{M} = RPK \cdot R_{En} + RDK \cdot (R_{En} - R_{Ed}) + RIK \cdot \sum_{i=n-NI_{M2}}^{n} R_{Et} \quad [5]$$

where:

indexes n, d, and t are similar to the homologous ones of formulas [1A] and [3], the summation so adding $NI_{M2}$ successive samples up to the present instant sample for the calculation of the integral contribution, and RPK, RDK, RIK are coefficients, possibly null.

In particular, RPK, RDK, RIK and $NI_{M2}$ are a ninth, a tenth, an eleventh, and a twelfth system setting parameters (and possibly even index d is a further system setting parameter).

The processing unit 30 also calculates a control parameter KTM indicating the weight to assign to the rotation with respect to the translation, which parameter is directly sent to the force compounding unit 34. In particular, the value KTM of such weight is calculated in a different way depending on whether a rotation ($R_C \neq 0$) is selected or not ($R_C \neq 0$):

$$KTM = \begin{cases} |TMRFG \cdot R_E| & \text{per } R_C \neq 0 \\ |TMHFG \cdot \omega_E| & \text{per } R_C = 0 \end{cases} \quad [6]$$

where TMRFG and TMHFG are a thirteenth and a fourteenth parameters (possibly null) of setting the system according to the invention.

In the PH mode, the processing unit 30 generates the thrust and/or the moment on the basis of the analysis of the deviations from the selected position and/or the selected bow angle as detected by the inboard instruments 3. Preferably, but not necessarily, the thrust and/or the moment are only generated when the deviations from the selected position and/or bow angle are larger than corresponding maximum thresholds. These quantities are used for closing the feedback loop and compensating the external force effects maintaining the position and the bow orientation. In other words, the processing unit 30 closes the feedback loop controlling the selected position and the selected bow angle, compensating the effects of external forces, inertia and other possible error causes for maintaining the selected position and attitude.

However, in extreme conditions, when the action of the manoeuvring means is not capable to oppose the external forces, priority is given to position maintenance. That is, if with the selected bow orientation the system is not capable to maintain the selected position, the bow orientation is modified searching for an angle more favourable for maintaining the position. This allows determining the best attitude for maintaining the selected position. Let us consider, for instance, a situation wherein the craft is exposed to a side wind so strong that the aerodynamic force cannot be opposed by the available side thrust; in this case, the system according to the invention favours the craft rotation in the direction more favourable for reaching a situation of stern or bow wind in which the main motors may easily oppose the effect of the wind. Preferably, the system, under limit conditions for maintenance of the selected position and bow orientation, signals to the pilot, for instance through a visual and/or sound warning, the occurrence of the limit situation before the restore manoeuvre is performed (for instance, the craft rotation up to determine the best attitude).

Figure 6:
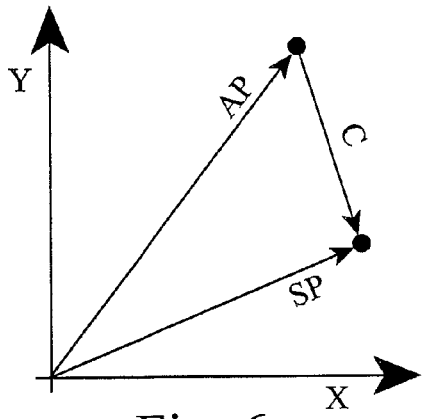
FIG. 6 schematically shows some other quantities considered by the system of FIG. 1.

With reference to FIG. 6, wherein the vectors representing:

selected position $\overrightarrow{SP}=[SP_X,SP_Y]$ to maintain, position $\overrightarrow{AP}=[AP_X,AP_Y]$ detected by the inboard instruments 3, and corrective movement $\vec{C}=[C_x,C_y]=\overrightarrow{SP}-\overrightarrow{AP}$ to perform, are schematically represented, the processing unit 30 determines the thrust to produce through the manoeuvring means, represented by the vector $\vec{S}=[S_X,S_Y]$, still preferably through a PID control represented by formula:

$$\vec{S} = PHPK\cdot\overrightarrow{C_n} + PHDK\cdot\left(\vec{C}_n - \vec{C}_d\right) + PHIK\cdot\sum_{t=n-NI_S}^{n}\overrightarrow{C_t} \qquad [7]$$

where:

indexes n, d, and t are similar to the homologous ones of formulas [1A], [3], and [5], the summation so adding $NI_S$ successive samples up to the present instant sample for the calculation of the integral contribution, and PHPK, PHDK, PHIK are coefficients, possibly null.

In particular, PHPK, PHDK, PHIK and $NI_S$ are a fifteenth, a sixteenth, a seventeenth, and an eighteenth system setting parameters (and possibly even index d is a further system setting parameter).

In the PH mode, the processing unit 30 determines the moment to produce through the manoeuvring means still through previous formula [3].

As said, the thrust and the moment to produce through the manoeuvring means, once calculated by the processing unit 30, are translated in specific adjustments of the manoeuvring means by the thrust generator 32 and the moment generator 33.

Both the generators 32 and 33 are based on Sugeno-type fuzzy logic with inference logic based on minimum operation and calculation of the activity coefficient based on the sum of al the activation for an output.

Figure 7:
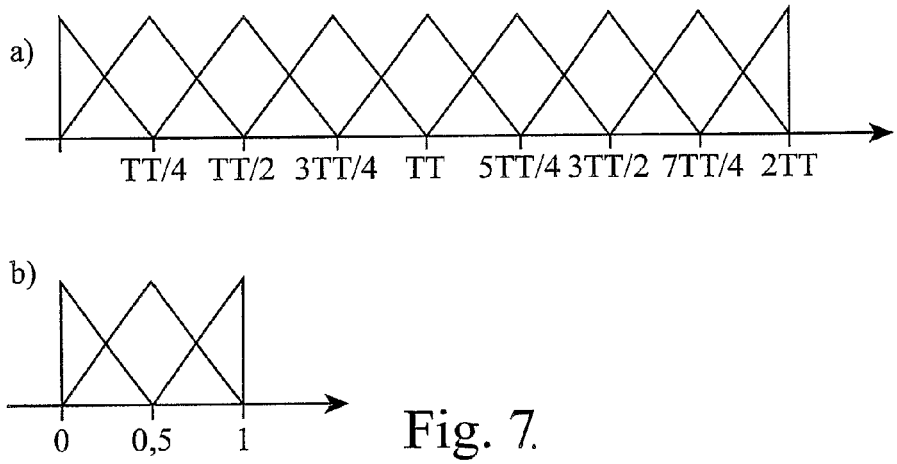
FIGS. 7*a*, 7*b*, and 8 schematically show some input member functions employed by a fuzzy logic used by the system of FIG. 1.

The input member functions for the thrust generator 32 of the preferred embodiment of the system are represented in FIG. 7: FIG. 7*a* shows the member function of the thrust direction, represented with an angle 0 to $2\pi$; FIG. 7*b* shows the member function of the thrust intensity, represented with a value ranging from 0 to 1.

Figure 8:
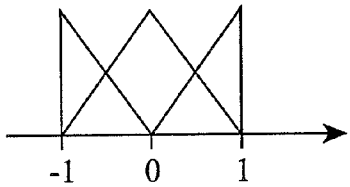

The input member function for the moment generator 33 is represented in FIG. 8, where the input variable, equal to the moment intensity, is represented with a value within the range −1 to 1.

It may be observed that the membership functions of the input variables of both generators have the same shape and uniformly distribute over the range of definition of the associated input variables, also optimising the noise rejection of the fuzzy model. However, other embodiments of the system according to the invention may define different shapes of such membership functions and distribute them in a non uniform way over the range of definition of the respective input variable. Furthermore, it is further possible to employ methods and instruments of optimisation and/or automatic learning of the number, the shape, and the distribution of the membership functions over the range of definition of the respective input variable.

Figure 9:
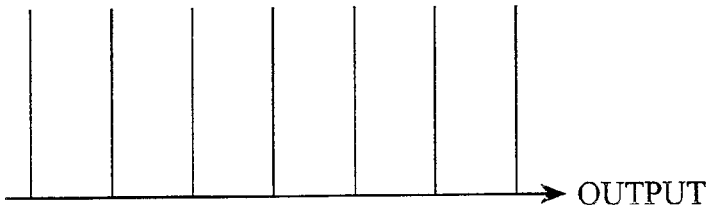
FIG. 9 schematically shows an output member function employed by the fuzzy logic used by the system of FIG. 1.

As schematically shown in FIG. 9, the output member functions have been assumed as set of singleton, i.e. fuzzy sets including only one element each: each value indicates the regulation for a certain actuator in the case when the activity coefficient is equal to 1, i.e. in the particular case when an associated rule is wholly true and the other ones are wholly false. In particular, an output member function is defined for each actuator, the number and the distribution of the singletons of which depends on the features of the craft and the characteristic parameters of which are determined in the phase of calibration of the system according to the invention.

As said, the values of the various antecedents are combined according to the minimum operator, while the value of the activity coefficient of each consequent (i.e. of each singleton output) is calculated on the basis of the sum of all the activations of that consequent (i.e. of that singleton output).

The so-called defuzzyfication is performed using the centroid method, i.e. the weighed mean of the output fuzzy values related to their respective total activity coefficient, outputting a signal for each manoeuvring means under consideration.

Although other embodiments of the system according to the invention may comprise different logic of operation of the generators 32 and 33, the fuzzy logic on which they are preferably based allows the control performed by the system according to the invention to adapt to variability of the operation conditions. Such variability is extremely dynamic and not much predictable, due to the nature of the system application to the control of a craft subject to variable and unpredictable meteorological and dynamics conditions. In other words, the fuzzy logic (preferably, but not necessarily, of Sugeno type with the features illustrated above), on which the generators 32 and 33 are preferably based, makes the system according to the invention adaptive to the various operation conditions which may occur.

As said, the fuzzy rules are of Sugeno type, wherein the consequent of the antecedents is substantially a function, representative of a (for instance linear or polynomial) model, of the inputs. These rules define the conditions in which a model is to be applied, by combining the function outputs.

For each actuator j, with j=1, . . . , N, where N≧1, controlled by the system according to the invention, the force compounding unit 34 compounds the values of the corresponding control signals coming from the thrust generator 32 and from the moment generator 33, which values are respectively indicated as $A_{TG}^{j}$ and $A_{MG}^{j}$. In particular, the unit 34 generates a sole compounded value $A_{TOT}^{j}$, for each actuator j, on the basis of the principle of superimposition of the effects, hence adding the values $A_{TG}^{j}$ from the thrust generator 32 and $A_{MG}^{j}$ from the moment generator 33, which are weighed through the control parameter KTM calculated by the processing unit 30 through formula [6]. Specifically, the unit 34 generates the compounded value $A_{TOT}^{j}$, for each actuator j, according to the following formula:

$$A_{TOT}^{j}=(1-KTM)A_{TG}^{j}+(1+KTM)A_{MG}^{j} \quad [8]$$

The actuator signal controller 35, that prepares the compounded signals $A_{TOT}^{j}$ coming from the unit 34 for the next transmission to the multiplexing unit 13, avoids sudden actions in the control signals $A^{j}$ sent to the actuators 4 through the third interface 14, such as, for instance, abrupt changes of the rotation condition of the motors or consecutive and close reversals of the rotation direction. Moreover, the controller 35 limits the value of the control signals $A^{j}$ within their respective predetermined range. In particular, the compounded values $A_{TOT}^{j}$, with j=1, . . . , N, where N≧1, calculated by the unit 34 according to formula [8], are modified by respective digital FIR type (i.e. finite impulsive response) filters, having an adjustable number of coefficients of adjustable value, where the number and the value of the coefficients are further system parameters which are preferably calibrated on the basis of the specific features of the craft.

Preferably, the signals are then re-scaled so as to have a maximum value ranging from −1 to 1. More in detail, once the maximum value M of the modules of the compounded signals $A_{TOT}^{j}$ has been determined:

$$M=\max\{|A^{1}_{TOT}|, \ldots |A^{j}_{TOT}|, \ldots |A^{N}_{TOT}|\} \quad [9]$$

and, if M>1, the following transformation is applied:

$$A^{j}=A^{j}_{TOT}|M \quad [10]$$

In particular, in order to avoid consecutive and close reversals of the rotation direction of the motors, one or more hysteretic functions $f_{H_ROT}^{j}$ are introduced which output respective signals $A^{j_ROT}$ of control of the motor rotation starting from the corresponding compounded signals $A_{TOT}^{j_ROT}$ coming from the unit 34 (possibly re-scaled through [10]):

$$A^{j_ROT} = f_{H_ROT}\left(A_{\mathrm{TOT}}^{j_ROT}\right) \quad [11]$$

The GPS processing unit 31, that receives data output by the sub-units 22 of interface with the GPS sensor, processes such data in order to make up for their finite resolution, due to the position acquisition GPS system. In particular, data coming from the GPS sensor are processed through a digital FIR type filter. The number of filter coefficients and their value are further system parameters and are preferably calibrated on the basis of the specific features of the craft.

In order to optimise the system operating for a specific craft is necessary to determine the set of parameters of optimal calibration. To this end, (preferably, but not necessarily, automatic) calibration procedures are performed which arrive, through the execution of a series of manoeuvres, at the determination of optimal parameters. The calibration procedures are preferably performed after the installation of the system on a craft and/or each time structural changes modify the features of the craft and/or periodically. Obviously, for a same type of craft the set of already determined set of optimal parameters is substantially the same, and, therefore, they may be directly set without need of tests on the sea. This is particularly useful in case of newly manufactured crafts or crafts belonging to a class for which the system has been already calibrated.

The preferred embodiment of the system according to the invention comprises two separated and successive calibration processes for determining, respectively, rotation calibration parameters and translation calibration parameters. In particular, the two calibration processes determine, for each actuator respectively involved in rotation and in translation, the number and the distribution of the singletons of the related output member function.

The rotation calibration process searches for the set of parameters (which define the various output member functions) minimising the movement of the centre of mass during rotation.

Figure 10:
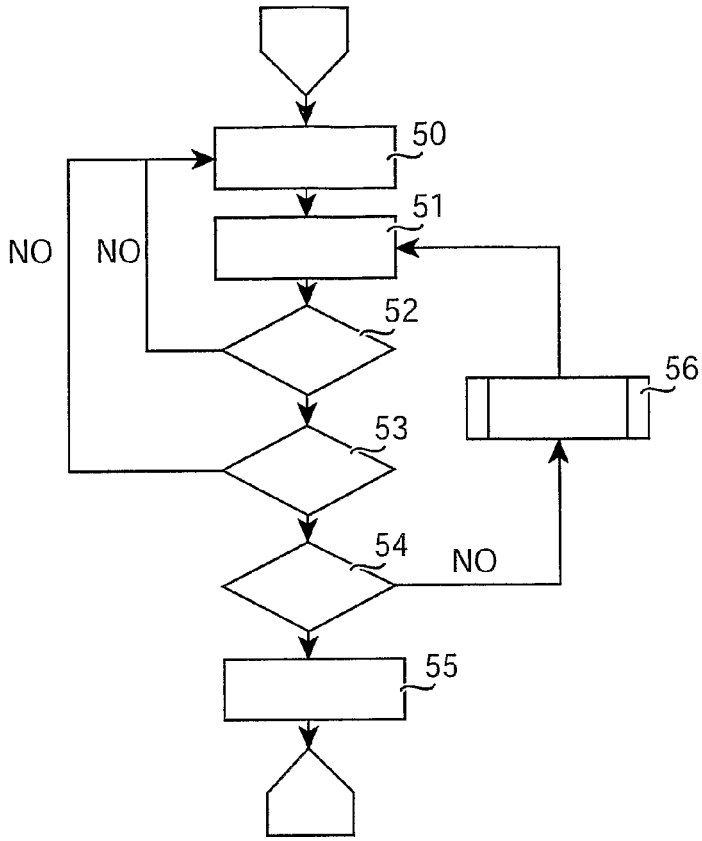
FIG. 10 schematically shows a first process of calibrating the system of FIG. 1.

With reference to FIG. 10, it may be observed that such process comprises a step 50 wherein the system according to the invention is initialised with an initial set of parameters (i.e. with a set of singleton output member functions), capable to produce an approximate rotation of the craft. The system then remains waiting for the craft motion, data of which are detected in step 51, reaches the steady state and, if a step 52 of verifying the steady state gives a positive outcome, the system verifies in a step 53 that a rotation ROT (i.e. a change of the yaw angle) has been performed (under steady state) that is larger than a predetermined minimum threshold $ROT^{MIN}$ ($ROT>ROT^{MIN}$), sufficient to ensure a reliable analysis of the motion features. When verification 53 gives a positive outcome, the distance $D^{ROT}$ run by the craft barycentre, indicative of the rotation error, is calculated and its value is evaluated in a verification step 54: in the case when the error $D^{ROT}$ is under a predetermined maximum threshold $D^{ROT_MAX}$ ($D^{ROT}<D^{ROT_MAX}$) the used parameter set is memorised in a step 55 as the optimal set, and the calibration process ends; otherwise, in the case when the distance $D^{ROT}$ run by the craft barycentre is larger that the maximum threshold $D^{ROT_MAX}$ ($D^{ROT}>D^{ROT_MAX}$), calibration parameter set is modified in a step 56 and the process is repeated from the motion detection step 51.

Figure 11:
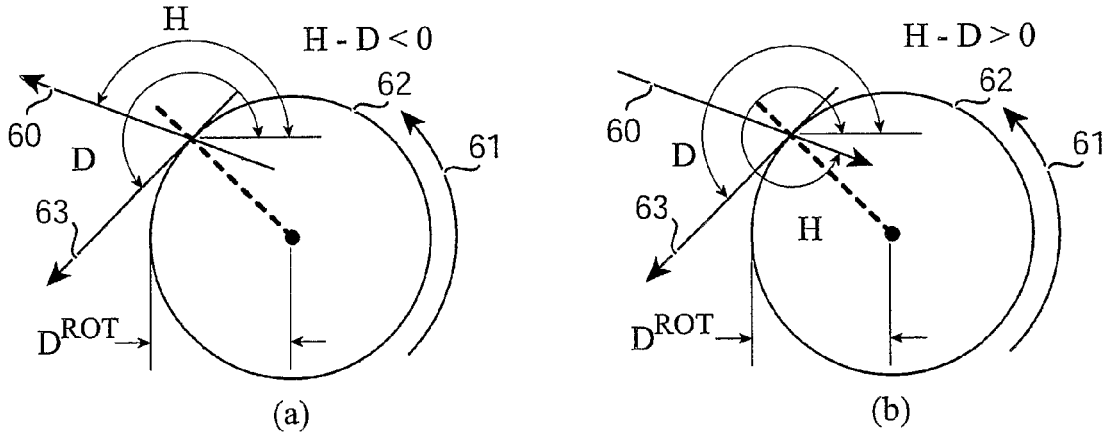
FIGS. 11*a* and 11*b* schematically show two situations occurring during the process of FIG. 10.

Step 56 of modification of the parameters operates as follows. Considering the circular path run by the craft barycentre under steady state, two possible conditions exist, which are schematised, respectively, in FIGS. 11*a* and 11*b*. In particular, in FIG. 11 the craft attitude is schematically represented by the arrow 60, wherein H represents the bow angle (having positive amplitude along the rotation angular direction, assumed as counterclockwise rotation in FIG. 11), while the characteristics of the path run by the craft barycentre are schematically represented by:

- a vector 63 representative of the craft barycentre speed at the end of the rotation, the direction of which is given by the angle D (having positive amplitude along the rotation angular direction), and
- a circle 62, schematising the path run by the craft barycentre, the diameter of which is equal to the distance $D^{ROT}$ run by the craft barycentre during the rotation, and that is tangent to the vector 63. The two possible conditions are:
- the craft turns the bow towards the outside of the circle 62, i.e. H−D<0 (FIG. 11*a*); or
- the craft turns the bow towards the inside of the circle 62, i.e. H−D>0 (FIG. 11*b*).

Assuming that the craft has a left motor and a right motor, step 56 modifies the calibration parameters (i.e., in the preferred embodiment of the system, it modifies the singletons of the output member functions associated with the steady state of the craft rotation) so as to decrease the left motor thrust $THRUST^{SX}$ or the right motor thrust $THRUST^{DX}$ (which in step 50 have been preferably initialised at a high value, still more preferably the maximum value) by a predetermined amount $\Delta_{THRUST}$, preferably equal to the minimum regulation of the thrust of the motors, according to the following formula:

$$\begin{cases} THRUST^{SX} = THRUST^{SX} - \Delta_{THRUST} & \text{for } H - D < 0 \\ THRUST^{DX} = THRUST^{DX} - \Delta_{THRUST} & \text{for } H - D > 0 \end{cases} \quad [12]$$

Formula [12] is immediately adaptable to cases in which the craft is provided with a different number and type of propelling means, in any case apt to produce a rotation of the same craft.

When the calibration process of the rotation parameters is ended, the calibration process for determining the singletons of the output member functions associated with the craft translation is performed. In particular, it is preferable that the order of the two processes is not reversed, since the translation calibration process is based on the capacity, by the control system, of opposing the undesired rotations, maintaining the bow angle fixed.

The calibration process of the translation parameters starts from an initial set of parameters and modifies it by adapting it to the craft. As in case of the calibration process of the rotation parameters, the calibration of the translation parameters is based on a feedback that tends to iteratively adjust the translation parameters for minimising the made translation error, the set of parameters determined at the end of a certain iteration of the process being used as new provisional set up to determining the optimal set (for which the error is tolerable). The preferred embodiment of the calibration process is repeated for all the membership functions of the input member function of the thrust direction in the fuzzy system, shown in FIG. 7*a*; in particular, by exploiting the fore-and-aft symmetry of the craft, the process may be limited only to the functions ranging from 0 to π. More in particular, the calibration process of the translation parameters determines the optimal output member functions, that is the singletons of the output member functions which produces the craft translation along the exact required direction when this corresponds to one of the central values of the membership functions of the input member function of the required thrust direction, i.e. when the required direction is equal to 0, π/4, π/2, 3π/4, and π. In these directions only one membership function of the input function (as shown in FIG. 7*a*) is activated, to which the activation of only one singleton of the output function must correspond (as shown in FIG. 9) for each actuator, whereby the value set for that actuator during the calibration is just the singleton value.

Figure 12:
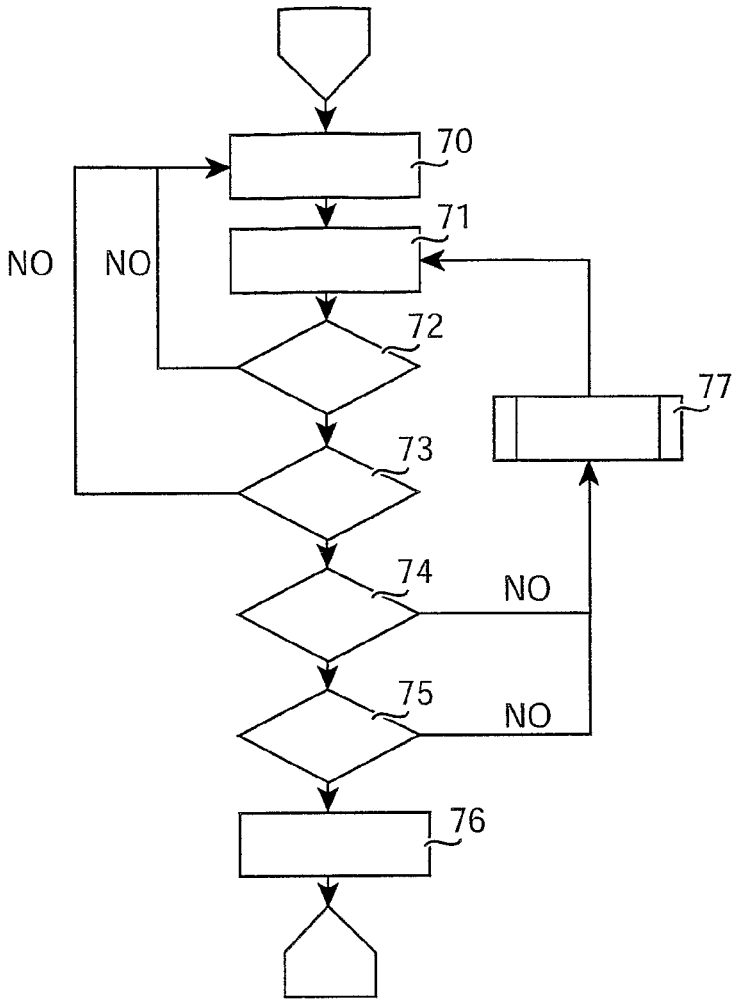
FIG. 12 schematically shows a second process of calibrating the system of FIG. 1.
Figure 13:
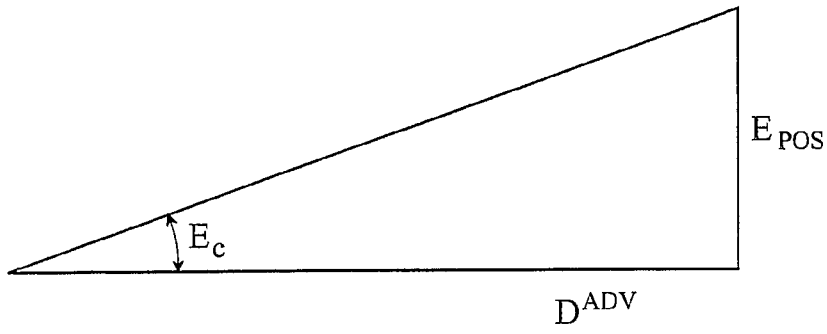
FIG. 13 schematically shows a situation occurring during the process of FIG. 12.
Figure 10:
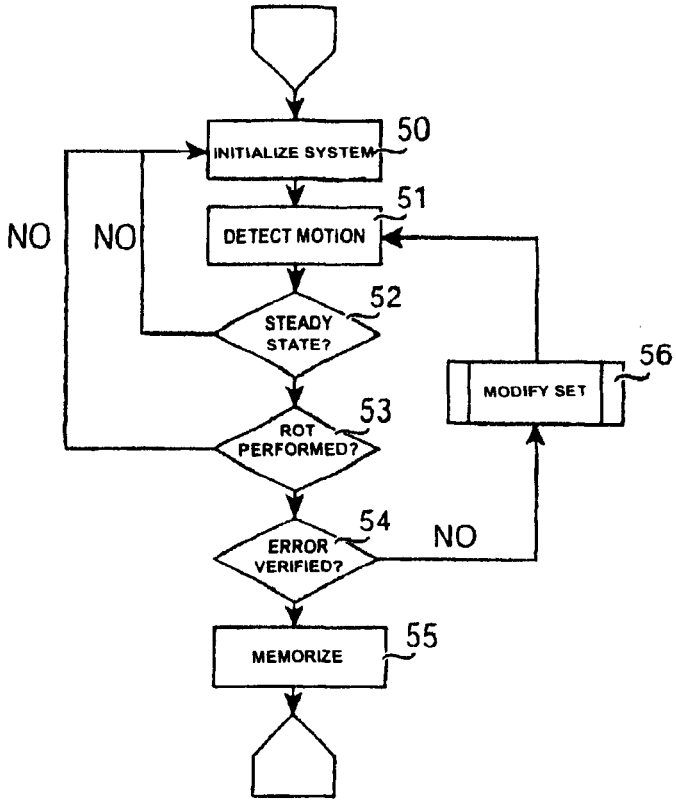
Figure 11:
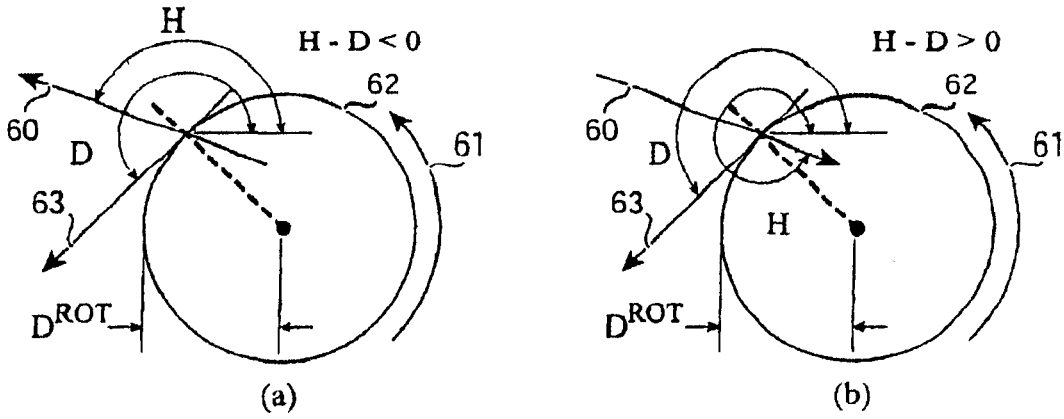
Figure 12:
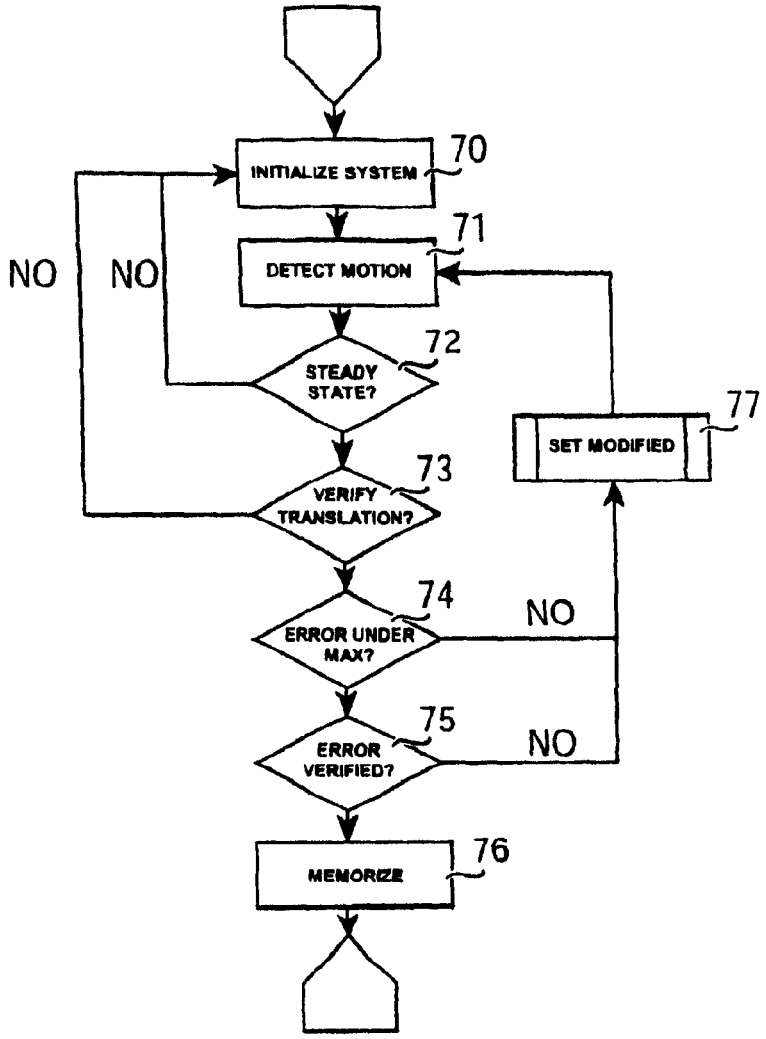
Figure 13:
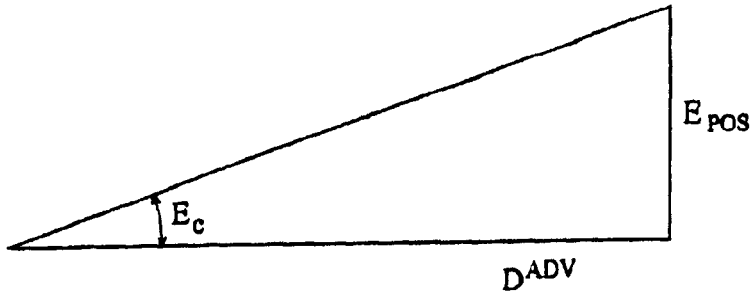

With reference to FIG. 12, the process comprises a step 70 of initialisation of the system with a set of translation parameters (i.e. with a set of singleton output member functions) that approximately leads the craft to make a translation along the required direction. The system remains waiting for the craft motion, data of which are detected in a step 71, reaches a steady state and, if a step 72 of verifying the steady state gives a positive outcome, the system verifies in a step 73 that a translation of amount $D_{ADV}$ has been performed (under steady state) that is larger than a predetermined minimum threshold $D^{ADV_MIN}$ ($D_{ADV} > D^{ADV_MIN}$), so as to make the angular error $E_C$ acceptable in the calculation of the translation direction C induced by the position error $E_{POS}$. In particular, as shown in FIG. 13, since it is assumed that $D_{ADV} >> E_{POS}$, it follows in the worst case (in which the angular error $E_C$ is larger, in module, than a maximum value $E_{C_MAX}$):

$$D^{ADV} > \frac{E_{POS}}{tg(E_{C_MAX})} \quad [13]$$

When the verification 73 gives a positive outcome, in a step 74 the angular error $E_{\Delta CI}$ of the translation direction is calculated, equal to the difference between the set movement direction $\vec{A}$ and the movement direction $\vec{I}$ detected by the inboard instruments 3, and its value is evaluated: in the case when this angular error $E_{\Delta C}$ is under a predetermined maximum threshold $E_{\Delta C_MAX}$ ($E_{\Delta C} < E_{\Delta C_MAX}$), it is verified in a step 75 whether the module of the correction $\vec{T}_E$ (determined through formula [1B]) made by the processing unit 30 is under a respective predetermined maximum threshold $TM_{MAX}$ ($|\vec{T}_E| < TM_{MAX}$), and, in the case when such verification gives a positive outcome, the used parameter set is memorised in a step 76 as the optimal set for the considered thrust direction, and the calibration process for that specific set direction ends. On the contrary, in the case when at least one of steps 74 and 75 gives a negative outcome, the set of system parameters is modified in a step 77, assuming as new singletons of the set of the output member functions the last values set for the respective actuators, and the process is repeated from the motion detection step 71.

The advantages offered by the system according to the invention are evident.

First of all, the system is extremely intuitive for a user piloting the craft, automatically compensating the effects of currents, wind and other possible external disturbances on the craft motion, performing the required movement or maintaining the position and the bow orientation set by the pilot.

Moreover, it is applicable, even by retrofitting, to crafts provided with shafting, stern motors or outboard motors, not requiring auxiliary manoeuvring means besides the main motors.

The present invention has been described, by way of illustration and not by way of limitation, according its preferred embodiment, but it should be understood that those skilled in the art can make variations and/or changes, without so departing from the related scope of protection, as defined by the enclosed claims.

The invention claimed is:

1. System of automatic control of manoeuvring a motor craft, comprising;

a command unit, a control unit connected to the command unit for receiving one or more signals of selection of a motion and/or a position of the craft, the control unit operative to send one or more control signals to an actuator which controls propelling and/or manoeuvring the craft, the control unit being further connected to instruments of the craft for receiving one or more detection signals, the control unit processing said one or more detection signals and said one or more selection signals for generating said one or more control signals so as to make the propelling and/or manoeuvring produce a thrust and/or a moment operative to make the craft assume the motion and/or the position selected by the command unit whereby the system substantially in real time compensates for disturbance of the motion and/or the selected position, wherein the control unit comprises:

a command processor that processes said one or more detection signals and said one or more selection signals and calculates the value of said thrust and/or the value of said moment;

a thrust generator that receives said value of thrust and generates one or more first intermediate signals of thrust control;

a moment generator that receives said value of moment and generates one or more second intermediate signals of moment control; and an actuator control that receives said one or more first intermediate signals of thrust control and said one or more second intermediate signals of moment control and generates said one or more control signals for the actuator, and wherein the actuator control comprises a force compounder that generates at least one compounded signal $A^J_{TOT}$, corresponding to one of said one or more control signals for the actuator through the sum of a corresponding first intermediate signal $A^J_{TOT}$, from said one or more first intermediate signals of thrust control, with a corresponding second intermediate signal $A^J_{MG}$, from said one or more second intermediate signals of moment control:

$$A^j_{TG}=A^j_{TG}+A^j_{MG}.$$

2. System according to claim 1, wherein the control unit generates said one or more control signals for the actuator according to a fuzzy logic, having an output variable for each one of said one or more control signals.

3. System according to claim 2, wherein said fuzzy logic is of Sugeno type.

4. System according to claim 2 wherein said fuzzy logic has inference logic based upon the minimum operation, calculation of the activity coefficient based upon the sum of all the activations for an output, and defuzzyfication based upon the centroid method.

5. System according to claim 2, wherein said fuzzy logic, for at least one input or output variable, uses a set of membership functions having identical shape and uniformly distributed over a range of values assumable by said at least one input or output variable.

6. System according to claim 2, wherein said fuzzy logic, for at least one output variable, uses a set of membership functions of singleton type.

7. System according to claim 6 wherein the system operates according to at least one parameter of operation or setting determinable through at least one calibration process.

8. System according to claim 7, wherein said at least one determinable parameter is one of said one or more first operation parameters defining a singleton of an output variable of said fuzzy logic.

9. System according to claim 7 wherein said at least one calibration process is automatic.

10. System according to claim 2, wherein for at least one input or output variable, said fuzzy logic uses a set of membership functions depending on one or more first operation parameters.

11. System according to claim 10, further comprising determining the set of membership functions of one or more input and/or output variables of said fuzzy logic.

12. System according to claim 1, wherein the system is adapted to operate according to a second operative mode in which said one or more control signals are generated so as to make the propelling and/or manoeuvring produce said thrust and/or said moment apt to make the craft maintain a position and/or a bow angle selected by the command unit.

13. System according to claim 12, wherein said one or more control signals are generated when the deviations of the position and/or the bow angle detected by the instruments from the position and/or the bow angle selected by the command unit are larger than, respectively, a first and a second maximum threshold.

14. System according to claim 12 wherein said one or more control signals are generated giving priority to the maintenance of the position.

15. System according to claim 1, wherein the thrust generator generates each one of said one or more first intermediate signals of thrust control as a defuzzyfied output variable calculated through said a fuzzy logic, employing as input variables the direction and the intensity of a thrust value.

16. System according to claim 1, wherein the moment generator generates each one of said one or more second intermediate signals of moment control as a defuzzyfied output variable calculated through a fuzzy logic, employing as input variables the intensity of said moment value.

17. System according to claim 1, wherein the force compounder generates said at least one compounded signal $A^J_{TOT}$ by weighing the contributions to said sum, given by the corresponding first intermediate signal $A^J_{TG}$ and by the corresponding second intermediate signal $A^J_{MG}$, through the control parameter KTM according to $$A^j_{TOT}=(1-KTM)A^j_{TG}+(1+KTM)A^j_{MG}.$$

18. System according to claim 1 further comprising a control manager connected to the control unit from which it is apt to receive as input at least one part of said one or more control signals, the control manager being further connected at the input to one or more control instruments with which the craft is provided, each one of which is operative to generate one or more further control signals corresponding to said at least one part of said one or more control signals generated by the control unit, the control manager being connected at the output to the actuator, whereby the control manager alternatively forwards to the actuator the input signals coming from the control unit or from said one or more control instruments.

19. System according to claim 18, wherein the control manager is selectable, whereby the input signals to forward to the output may be selected.

20. System according to claim 1, wherein the command unit sends to the control unit one or more signals of selection of a translation motion and/or of a rotation motion and/or of a position and/or of an attitude of the craft.

21. System according to claim 1, wherein the command unit comprises at least one command unit selected from the group consisting of joystick, pointing device, lever device, control stick, touch-screen, speech command computerised device, a keypad, and radio control.

22. System according to claim 21, wherein the at least one command unit is connected to the control unit through a wireless connection.

23. System according to claim 22, wherein said wireless connection is a connection according to WiFi technology.

24. System according to claim 1, further comprising a display, acoustic device, or signalling device.

25. System according to claim 1 wherein the instruments comprise a component selected from the group consisting of GPS position sensor, electronic compass, anemometer, and liquid current meter.

26. System of automatic control of manoeuvring a motor craft, comprising:

a command unit, a control unit connected to the command unit for receiving one or more signals of selection of a motion and/or a position of the craft, the control unit operative to send one or more control signals to an actuator which controls propelling and/or manoeuvring the craft, the control unit being further connected to instruments of the craft for receiving one or more detection signals, the control unit processing said one or more detection signals and said one or more selection signals for generating said one or more control signals so as to make the propelling and/or manoeuvring produce a thrust and/or a moment operative to make the craft assume the motion and/or the position selected by the command unit whereby the system substantially in real time compensates for disturbance of the motion and/or the selected position, wherein the control unit comprises:

a command processor that processes said one or more detection signals and said one or more selection signals and calculates the value of said thrust and/or the value of said moment;

a thrust generator that receives said value of thrust and generates one or more first intermediate signals of thrust control;

a moment generator that receives said value of moment and generates one or more second intermediate signals of moment control; and an actuator control that receives said one or more first intermediate signals of thrust control and said one or more second intermediate signals of moment control and generates said one or more control signals for the actuator, wherein said system is operative according to a first operative mode in which said one or more control signals are generated so as to make the propelling and/or manoeuvring produce said thrust and/or said moment operative to make the craft assume a translation motion and/or a rotation motion selected by the command unit, and wherein in the first operative mode the command processor calculates a versor $\vec{S}_1=[S_{1X},S_{1Y}]=[\cos(\alpha_S),\sin(\alpha_S)]$, representative of the direction of said thrust, on the basis of a versor $\vec{A}$ representative of the movement direction selected by the command unit, and a vector $\vec{I}$ representative of the translation speed detected by the instruments, through a PID (Proportional, Integral, Derivative) control according to $$\vec{B} = \vec{A} + TPK \cdot \overrightarrow{T_{En}} + TDK \cdot \left(\overrightarrow{T_{En}} - \overrightarrow{T_{Ed}}\right) + TIK \cdot \sum_{t=n-NI_B}^{n} \overrightarrow{T_{Et}}$$

wherein vector $\vec{T}$ is given by $\vec{T}_E=\vec{A}\cdot|\vec{I}|-\vec{I}$ and where:

index n indicates the present instant sample, index d indicates a sample at an instant preceding the present one, index t of summation ranges from $(n-NI_B)$ to n, and TPK, TDK, and TIK and $NI_B$ are a first, a second, a third, and a fourth setting parameters, the command processor calculating versor $\vec{S}_1$ according to $$\vec{S_1} = \frac{\vec{B}}{|\vec{B}|}$$

and calculating the intensity TH of said thrust proportionally to at least one of said one or more selection signals.

27. System according to claim 26, wherein in the first operative mode the command processor calculates the direction and the intensity of said thrust as a sum of a first vector, representing the direction and the intensity of the translation selected by the command unit with a second vector, proportional to the difference between said first vector and a second vector representing the direction and the intensity of the translation detected by the instruments.

28. System of automatic control of manoeuvring a motor craft, comprising:

a command unit, a control unit connected to the command unit for receiving one or more signals of selection of a motion and/or a position of the craft, the control unit operative to send one or more control signals to an actuator which controls propelling and/or manoeuvring the craft, the control unit being further connected to instruments of the craft for receiving one or more detection signals, the control unit processing said one or more detection signals and said one or more selection signals for generating said one or more control signals so as to make the propelling and/or manoeuvring produce a thrust and/or a moment operative to make the craft assume the motion and/or the position selected by the command unit whereby the system substantially in real time compensates for disturbance of the motion and/or the selected position, wherein the control unit comprises:

a command processor that processes said one or more detection signals and said one or more selection signals and calculates the value of said thrust and/or the value of said moment;

a thrust generator that receives said value of thrust and generates one or more first intermediate signals of thrust control;

a moment generator that receives said value of moment and generates one or more second intermediate signals of moment control; and an actuator control that receives said one or more first intermediate signals of thrust control and said one or more second intermediate signals of moment control and generates said one or more control signals for the actuator, wherein said system is operative according to a first operative mode in which said one or more control signals are generated so as to make the propelling and/or manoeuvring produce said thrust and/or said moment operative to make the craft assume a translation motion and/or a rotation motion selected by the command unit, and wherein in the first operative mode when the command unit selects no rotation, the command processor calculates said moment M through a PID control according to:

$$\vec{M} = NRPK \cdot \omega_{En} + NRDK \cdot (\omega_{En} - \omega_{Ed}) + NRIK \cdot \sum_{t=n-NI_{M1}}^{n} \omega_{Et}$$

where $\omega_E$ is equal to the error between a yaw angle $\omega_i$ detected by the instruments and a yaw angle $\omega$ selected by the command unit $$\omega_E = \omega_I - \omega$$

index n indicates the present instant sample, index d indicates a sample at an instant preceding the present one, index t of summation ranges from $(n-NI_{M1})$ to n, and NRPK, NRDK, NRIK and $NI_{M1}$ are a fifth, a sixth, a seventh, and an eighth setting parameters.

29. System of automatic control of manoeuvring a motor craft, comprising:

a command unit, a control unit connected to the command unit for receiving one or more signals of selection of a motion and/or a position of the craft, the control unit operative to send one or more control signals to an actuator which controls propelling and/or manoeuvring the craft, the control unit being further connected to instruments of the craft for receiving one or more detection signals, the control unit processing said one or more detection signals and said one or more selection signals for generating said one or more control signals so as to make the propelling and/or manoeuvring produce a thrust and/or a moment operative to make the craft assume the motion and/or the position selected by the command unit whereby the system substantially in real time compensates for disturbance of the motion and/or the selected position, wherein the control unit comprises:

a command processor that processes said one or more detection signals and said one or more selection signals and calculates the value of said thrust and/or the value of said moment;

a thrust generator that receives said value of thrust and generates one or more first intermediate signals of thrust control;

a moment generator that receives said value of moment and generates one or more second intermediate signals of moment control; and an actuator control that receives said one or more first intermediate signals of thrust control and said one or more second intermediate signals of moment control and generates said one or more control signals for the actuator, wherein said system is operative according to a first operative mode in which said one or more control signals are generated so as to make the propelling and/or manoeuvring produce said thrust and/or said moment operative to make the craft assume a translation motion and/or a rotation motion selected by the command unit, and wherein in the first operative mode when the command unit selects a rotation $R_C$, the command processor calculates said moment M through a PID control according to $$\vec{M} = RPK \cdot R_{En} + RDK \cdot (R_{En} - R_{Ed}) + RIK \cdot \sum_{t=n-NI_{M2}}^{n} R_{Et}$$

where $R_E$ is equal to the error between a selected rotation $R_C$ and a rotation speed $$\frac{d\omega}{dt}$$

detected by the instruments $$R_E = R_C - \frac{d\omega}{dt}$$

index n indicates the present instant sample, index d indicates a sample at an instant preceding the present one, index t of summation ranges from $(n-NI_{M2})$ to n, and RPK, RDK, RIK and $NI_{M2}$ are a ninth, a tenth, an eleventh, and a twelfth setting parameters.

30. System of automatic control of manoeuvring a motor craft, comprising:

a command unit, a control unit connected to the command unit for receiving one or more signals of selection of a motion and/or a position of the craft, the control unit operative to send one or more control signals to an actuator which controls propelling and/or manoeuvring the craft, the control unit being further connected to instruments of the craft for receiving one or more detection signals, the control unit processing said one or more detection signals and said one or more selection signals for generating said one or more control signals so as to make the propelling and/or manoeuvring produce a thrust and/or a moment operative to make the craft assume the motion and/or the position selected by the command unit whereby the system substantially in real time compensates for disturbance of the motion and/or the selected position, wherein the control unit comprises:

a command processor that processes said one or more detection signals and said one or more selection signals and calculates the value of said thrust and/or the value of said moment;

a thrust generator that receives said value of thrust and generates one or more first intermediate signals of thrust control;

a moment generator that receives said value of moment and generates one or more second intermediate signals of moment control; and an actuator control that receives said one or more first intermediate signals of thrust control and said one or more second intermediate signals of moment control and generates said one or more control signals for the actuator, wherein the command processor calculates a control parameter that is sent to a force compounder that uses the control parameter in generating said one or more control signals for the actuator for assigning a weight to said one or more second intermediate signals of moment control with respect to said one or more first intermediate signals of thrust control, the control parameter being calculated as a function of a selected rotation $R_C$ selected by the command unit according to $$KTM = \begin{cases} |TMRFG \cdot R_E| & \text{for } R_C \neq 0 \\ |TMHFG \cdot \omega_E| & \text{for } R_C = 0 \end{cases}$$

where $R_E$ is equal to the error between the selected rotation $R_C$ and a rotation speed $$\frac{d\omega}{dt}$$

detected by the instruments $$R_E = R_C - \frac{d\omega}{dt}$$

$\omega_E$ is equal to the error between a yaw angle $\omega_i$ detected by the instruments and a yaw angle $\omega$ selected by the command unit $\omega_E = \omega_I - \omega$ and TMRFG and TMHFG are a thirteenth and a fourteenth setting parameters.

31. System of automatic control of manoeuvring a motor craft, comprising:

a command unit, a control unit connected to the command unit for receiving one or more signals of selection of a motion and/or a position of the craft, the control unit operative to send one or more control signals to an actuator which controls propelling and/or manoeuvring the craft, the control unit being further connected to instruments of the craft for receiving one or more detection signals, the control unit processing said one or more detection signals and said one or more selection signals for generating said one or more control signals so as to make the propelling and/or manoeuvring produce a thrust and/or a moment operative to make the craft assume the motion and/or the position selected by the command unit whereby the system substantially in real time compensates for disturbance of the motion and/or the selected position, wherein the control unit comprises:

a command processor that processes said one or more detection signals and said one or more selection signals and calculates the value of said thrust and/or the value of said moment;

a thrust generator that receives said value of thrust and generates one or more first intermediate signals of thrust control;

a moment generator that receives said value of moment and generates one or more second intermediate signals of moment control; and an actuator control that receives said one or more first intermediate signals of thrust control and said one or more second intermediate signals of moment control and generates said one or more control signals for the actuator, wherein the system is adapted to operate according to a second operative mode in which said one or more control signals are generated so as to make the propelling and/or manoeuvring produce said thrust and/or said moment apt to make the craft maintain a position and/or a bow angle selected by the command unit, and wherein in the second operative mode the command processor calculates a vector $\vec{S}$ of said thrust through a PID control according to formula $$\vec{S} = PHPK \cdot \vec{C_n} + PHDK \cdot (\vec{C_n} - \vec{C_d}) + PHIK \cdot \sum_{t=n-NI_s}^{n} \vec{C_i}$$

where $\vec{C}$ is a vector representative of a corrective movement, equal to the difference between a vector $\vec{SP}$ representative of the position selected by the command unit and a vector $\vec{AP}$ representative of the position detected by the instruments $$\vec{C} = \vec{SP} - \vec{AP},$$

index n indicates the present instant sample, index d indicates a sample at an instant preceding the present one, index t of summation ranges from (n−NIs) to n, and PHPK, PHDK, PHIK and $NI_S$ are a fifteenth, a sixteenth, a seventeenth, and an eighteenth setting parameters.

32. System of automatic control of manoeuvring a motor craft, comprising:

a command unit, a control unit connected to the command unit for receiving one or more signals of selection of a motion and/or a position of the craft, the control unit operative to send one or more control signals to an actuator which controls propelling and/or manoeuvring the craft, the control unit being further connected to instruments of the craft for receiving one or more detection signals, the control unit processing said one or more detection signals and said one or more selection signals for generating said one or more control signals so as to make the propelling and/or manoeuvring produce a thrust and/or a moment operative to make the craft assume the motion and/or the position selected by the command unit whereby the system substantially in real time compensates for disturbance of the motion and/or the selected position, wherein the control unit comprises:

a command processor that processes said one or more detection signals and said one or more selection signals and calculates the value of said thrust and/or the value of said moment;

a thrust generator that receives said value of thrust and generates one or more first intermediate signals of thrust control;

a moment generator that receives said value of moment and generates one or more second intermediate signals of moment control; and an actuator control that receives said one or more first intermediate signals of thrust control and said one or more second intermediate signals of moment control and generates said one or more control signals for the actuator, wherein the system is adapted to operate according to a second operative mode in which said one or more control signals are generated so as to make the propelling and/or manoeuvring produce said thrust and/or said moment apt to make the craft maintain a position and/or a bow angle selected by the command unit, and wherein in the second operative mode the command processor calculates said moment M through a PID control according to formula $$\vec{M} = RPK \cdot R_{En} + RDK \cdot (R_{En} - R_{Ed}) + RIK \cdot \sum_{t=n-NI_{M2}}^{n} R_{Et}$$

where $R_E$ is equal to the error between a selected rotation $R_C$ and a rotation speed $$\frac{d\omega}{dt}$$

detected by the instruments $$R_E = R_C - \frac{d\omega}{dt}$$

index n indicates the present instant sample, index d indicates a sample at an instant preceding the present one, index t of summation ranges from ($n-NI_{M2}$) to n, and RPK, RDK, RIK and $NI_{M2}$ are a ninth, a tenth, an eleventh, and a twelfth setting parameters.

33. System of automatic control of manoeuvring a motor craft, comprising:

a command unit, a control unit connected to the command unit for receiving one or more signals of selection of a motion and/or a position of the craft, the control unit operative to send one or more control signals to an actuator which controls propelling and/or manoeuvring the craft, the control unit being further connected to instruments of the craft for receiving one or more detection signals, the control unit processing said one or more detection signals and said one or more selection signals for generating said one or more control signals so as to make the propelling and/or manoeuvring produce a thrust and/or a moment operative to make the craft assume the motion and/or the position selected by the command unit whereby the system substantially in real time compensates for disturbance of the motion and/or the selected position, wherein the control unit comprises:

a command processor that processes said one or more detection signals and said one or more selection signals and calculates the value of said thrust and/or the value of said moment;

a thrust generator that receives said value of thrust and generates one or more first intermediate signals of thrust control;

a moment generator that receives said value of moment and generates one or more second intermediate signals of moment control; and an actuator control that receives said one or more first intermediate signals of thrust control and said one or more second intermediate signals of moment control and generates said one or more control signals for the actuator, wherein the actuator control is adapted to control and give the values of said one or more control signals for the actuator, and wherein the value $A^j$ of at least one control signal for the actuator is given by a respective hysteretic function $f^J_H$ of a corresponding compounded signal $A^J_{TOT}$ generated by a force compounder:

$$A^j = f_H(A^j_{TOT}).$$

34. System according to claim 33, wherein the actuator control prevents at least one signal of control of rotation of a motor, from said one or more control signals for the actuator from producing abrupt changes of the rotation condition of said motor.

35. System according to claim 33, wherein the actuator control prevents at least one signal ($A^{J\text{-}ROT}$) of control of rotation of a motor, from said one or more, control signals for the actuator from producing consecutive and close reversals of the rotation direction of said motor.

36. System according to claim 33, wherein at least one compounded signal $A^J_{TOT}$ generated by a force compounder is modified by a respective digital finite impulsive response or FIR filter.

37. System according to claim 36, wherein said FIR filter depends on one or more second operation parameters.

38. System according to claim 33, wherein at least one compounded signal $A^J_{TOT}$, generated by a force compounder is re-scaled.

39. System according to claim 33, wherein said hysteretic function $f^J_H$ depends on one or more third operation parameters.

40. Calibration process of one or more parameters of operation or setting of a system of automatic control of manoeuvre of motor crafts, said system comprising a command unit, a control unit connected to the command unit for receiving one or more signals of selection of a motion and/or a position of the craft, the control unit operative to send one or more control signals to an actuator which controls propelling and/or manoeuvring the craft, the control unit being further connected to instruments of the craft for receiving one or more detection signals, the control unit processing said one or more detection signals and said one or more selection signals for generating said one or more control signals so as to make the propelling and/or manoeuvring produce a thrust and/or a moment operative to make the craft assume the motion and/or the position selected by the command unit whereby the system substantially in real time compensates for disturbance of the motion and/or the selected position, wherein the control unit generates said one or more control signals for the actuator according to a fuzzy logic, having an output variable for each one of said one or more control signals, wherein said fuzzy logic, for at least one output variable, uses a set of membership functions of singleton type, and wherein the system operates according to at least one parameter of operation or setting determinable through at least one calibration process, said one or more parameters being related to the generation of one or more control signals apt to make propelling and/or manoeuvring produce a rotation of the craft, the process starting from an initial set of said one or more parameters of rotation, the process being characterised in that it comprises the following step:

J. producing one or more selection signals of a rotation, motion, for making the system generate one or more control signals, K. calculating the distance $D^{ROT}$ run by the barycentre of the craft, L. verifying whether the distance $D^{ROT}$ is shorter than a predetermined maximum threshold $DR^{ROT_MAX}$, M. in the case when step L gives a positive outcome, memorising the set of rotation parameters used by the system for generating said one or more control signals and ending the process, N. in the case when step L gives a negative outcome, modifying one or more rotation parameters so as to reduce the distance $D^{ROT}$ and repeating the process starting from step J.

41. Process according to claim 40, wherein step N comprises the following sub-steps:

N.1 verifying whether the craft turns the bow towards the outside of a circle the diameter of which is equal to the distance $D^{ROT}$ and that is tangent to a vector representative of the speed of the craft barycentre at the end of rotation, said circle being placed within the half plane to which the barycentre position belongs at the beginning of rotation, N.2 in the case when sub-step N.1 gives a positive outcome, modifying said one or more rotation parameters so as to reduce the leftward thrust, with respect to the rightward thrust, of the propelling and/or manoeuvring of the craft, and N.3 in the case when sub-step N.1 gives a negative outcome, modifying one or more rotation parameters so as to reduce the rightward thrust, with respect to the leftward thrust, of the propelling and/or manoeuvring of the craft.

42. Calibration process of one or more parameters of operation or setting of a system of automatic control of manoeuvre of motor crafts, said system comprising a command unit, a control unit connected to the command unit for receiving one or more signals of selection of a motion and/or a position of the craft, the control unit operative to send one or more control signals to an actuator which controls propelling and/or manoeuvring the craft, the control unit being further connected to instruments of the craft for receiving one or more detection signals, the control unit processing said one or more detection signals and said one or more selection signals for generating said one or more control signals so as to make the propelling and/or manoeuvring produce a thrust and/or a moment operative to make the craft assume the motion and/or the position selected by the command unit whereby the system substantially in real time compensates for disturbance of the motion and/or the selected position, wherein the control unit generates said one or more control signals for the actuator according to a fuzzy logic, having an output variable for each one of said one or more control signals, wherein said fuzzy logic, for at least one output variable, uses a set of membership functions of singleton type, and wherein the system operates according to at least one parameter of operation or setting determinable through at least one calibration process, said one or more parameters being related to the generation of one or more control signals apt to make propelling and/or manoeuvring produce a translation of the craft, the process starting from an initial set of said one or more translation parameters, the process being characterised in that it comprises, for at least one direction of translation, the following step:

P. producing one or more signals of selection of a translation motion, for making the system generate one or more control signals, Q. calculating the angular error $E_{\Delta CI}$ of the direction of translation effectively followed by the craft, detected by the instruments, with respect to the direction of the selected translation motion, R. verifying whether the angular error $E_{\Delta CI}$ is lower than a predetermined maximum threshold $E_{C_MAX}$, S. in the case when step R gives a positive outcome, memorising the set of translation parameters used by the system for generating said one or more control signals and ending the process, T. in the case when step R gives a negative outcome, modifying said one or more translation parameters so as to reduce the angular deviation $E_C$ and repeating the process starting from step P.

43. Process according to claim 42, wherein step S memorises the set of translation parameters used by the system for generating said one or more control signals only if a vector representative of a correction of said translation, that is induced by the control unit, is lower in module than a respective predetermined maximum threshold $TM_{MAX}$, otherwise step T is executed.

44. Craft, comprising an actuator that controls propelling and/or manoeuvring, instruments and a system of automatic control of manoeuvre a motor craft according to claim 1.

* * * * *

UNITED STATES PATENT AND TRADEMARK OFFICE

CERTIFICATE OF CORRECTION

PATENT NO. : 7,818,108 B2
APPLICATION NO. : 11/576833
DATED : October 19, 2010
INVENTOR(S) : Stefano Bertazzoni It is certified that error appears in the above-identified patent and that said Letters Patent is hereby corrected as shown below:

Delete Drawing Sheets 4 and 5 and substitute therefore the attached Drawing Sheets 4 and 5 consisting of corrected FIGS. 10 and 12.

Signed and Sealed this

Seventh Day of December, 2010

David J. Kappos

David J. Kappos
*Director of the United States Patent and Trademark Office*